US008826972B2

(12) United States Patent
Flint et al.

(10) Patent No.: US 8,826,972 B2
(45) Date of Patent: Sep. 9, 2014

(54) PLATFORM FOR ELECTRICALLY COUPLING A COMPONENT TO A DOWNHOLE TRANSMISSION LINE

(75) Inventors: Jason C. Flint, Provo, UT (US); Monte L. Johnson, Orem, UT (US)

(73) Assignee: Intelliserv, LLC, Houston, TX (US)

( * ) Notice: Subject to any disclaimer, the term of this patent is extended or adjusted under 35 U.S.C. 154(b) by 387 days.

(21) Appl. No.: 12/107,403

(22) Filed: Apr. 22, 2008

(65) Prior Publication Data

US 2008/0251247 A1 Oct. 16, 2008

Related U.S. Application Data

(63) Continuation-in-part of application No. 11/161,270, filed on Jul. 28, 2005, now abandoned.

(51) Int. Cl.

| | |
|---|---|
| ***E21B 47/16*** | (2006.01) |
| ***E21B 17/02*** | (2006.01) |
| ***E21B 17/00*** | (2006.01) |

(52) U.S. Cl.

CPC ..... *E21B 17/006* (2013.01); *E21B 17/028* (2013.01)

USPC ..... 166/65.1; 166/250.11

(58) Field of Classification Search

USPC ..... 166/250.11, 65.1, 66, 380, 242.6; 439/620.03, 620.07

See application file for complete search history.

(56) References Cited

U.S. PATENT DOCUMENTS

| | | | | |
|---|---|---|---|---|
| 2,414,719 | A | | 1/1947 | Cloud |
| 2,678,963 | A | | 5/1954 | Everhart |
| 3,260,971 | A | | 7/1966 | Bacher et al. |
| 3,517,375 | A | | 6/1970 | Mancini |
| 3,518,608 | A | | 6/1970 | Papadopoulos |
| 4,126,370 | A | | 11/1978 | Nijman |
| 4,202,490 | A | | 5/1980 | Gunkel et al. |
| 4,494,092 | A | | 1/1985 | Griffin |
| 4,605,914 | A | | 8/1986 | Harman |
| 4,739,325 | A | | 4/1988 | MacLeod |
| 4,788,544 | A | | 11/1988 | Howard |
| 5,142,128 | A | | 8/1992 | Perkin et al. |
| 5,202,680 | A | | 4/1993 | Savage |
| 5,382,932 | A | * | 1/1995 | Monti ..... 333/245 |
| 5,457,447 | A | | 10/1995 | Ghaem et al. |
| 5,497,140 | A | | 3/1996 | Tuttle |
| 5,566,056 | A | | 10/1996 | Chaudhry |
| 5,608,199 | A | | 3/1997 | Clouse et al. |
| 5,680,459 | A | | 10/1997 | Hook |
| 5,682,143 | A | | 10/1997 | Brady et al. |
| 5,751,534 | A | | 5/1998 | DeBalko |

(Continued)

OTHER PUBLICATIONS

PCT/US03/16475, Published Dec. 4, 2003, Applicant Baker Hughes; International Search Report: "Documents Considered to Be Relevant".

*Primary Examiner* — David Andrews

(74) *Attorney, Agent, or Firm* — Conley Rose, P.C.

(57) ABSTRACT

An apparatus in accordance with the invention includes, in one embodiment, a substantially planar recessed surface for mounting and retaining a component. The platform is configured to electrically couple the component to a transmission line at a non-end point thereof. An outer contour of the component does not exceed an outer contour of the platform, and the outer contour of the platform does not exceed an outer contour of the transmission line. The transmission line is configured to link to a downhole network, and the component is configured to affect a signal on the transmission line.

40 Claims, 21 Drawing Sheets

(56) References Cited

U.S. PATENT DOCUMENTS 5,991,602 A 11/1999 Sturm
5,997,335 A 12/1999 Kameyama et al.
6,012,015 A 1/2000 Tubel
6,025,780 A 2/2000 Bowers et al.
6,078,259 A 6/2000 Brady et al.
6,165,019 A 12/2000 Kha et al.
6,252,518 B1 6/2001 Laborde
6,276,466 B1 8/2001 Boyd
6,324,904 B1 12/2001 Ishikawa et al.
6,333,699 B1 12/2001 Zierolf
6,333,700 B1 12/2001 Thomeer et al.
6,347,292 B1 2/2002 Denny et al.
6,359,569 B2 3/2002 Beck et al.
6,377,176 B1 4/2002 Lee
6,380,826 B1 * 4/2002 Palinkas ..... 333/175
6,392,317 B1 5/2002 Hall et al.
6,443,228 B1 9/2002 Aronstam et al.
6,450,259 B1 9/2002 Song et al.
6,480,811 B2 11/2002 Denny et al.
6,536,524 B1 3/2003 Snider
6,597,175 B1 7/2003 Brisco
6,604,063 B2 8/2003 Denny et al.
6,666,274 B2 12/2003 Hughes
6,670,880 B1 12/2003 Hall et al.
6,688,396 B2 2/2004 Floerke et al.
6,710,600 B1 3/2004 Kopecki et al.
6,717,501 B2 4/2004 Hall et al.
6,720,764 B2 4/2004 Rellon et al.
6,759,968 B2 7/2004 Zierolf
6,761,219 B2 7/2004 Snider et al.
6,794,957 B2 9/2004 Shafer et al.
6,799,632 B2 10/2004 Hall et al.
6,821,147 B1 11/2004 Hall et al.
6,830,467 B2 12/2004 Hall et al.
6,844,498 B2 1/2005 Hall et al.
6,866,306 B2 3/2005 Boyle et al.
6,888,473 B1 5/2005 Hall et al.
6,913,093 B2 7/2005 Hall et al.
6,929,493 B2 8/2005 Hall et al.
6,945,802 B2 9/2005 Hall et al.
6,968,611 B2 11/2005 Hall et al.
7,052,283 B2 5/2006 Pixley et al.
7,278,887 B1 10/2007 Palinkas et al.
7,393,245 B2 7/2008 Palinkas et al.
7,404,737 B1 7/2008 Youtsey
7,419,403 B1 9/2008 Paynter
7,422,477 B2 9/2008 Eriksen
7,425,153 B1 9/2008 Miller
7,425,161 B2 9/2008 Morikawa et al.
2004/0020643 A1 2/2004 Thomeer et al.
2004/0039466 A1 2/2004 Lilly et al.
2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0204856 A1 10/2004 Jenkins et al.
2004/0216847 A1 11/2004 Hall et al.
2004/0244916 A1 12/2004 Hall et al.
2004/0244964 A1 12/2004 Hall et al.
2004/0246142 A1 12/2004 Hall et al.
2004/0256113 A1 12/2004 LoGiudice et al.
2005/0001735 A1 1/2005 Hall et al.
2005/0001736 A1 1/2005 Hall et al.
2005/0001738 A1 1/2005 Hall et al.
2005/0035874 A1 2/2005 Hall et al.
2005/0035875 A1 2/2005 Hall et al.
2005/0035876 A1 2/2005 Hall et al.
2005/0036507 A1 2/2005 Hall et al.
2005/0039912 A1 2/2005 Hall et al.
2005/0045339 A1 3/2005 Hall et al.
2005/0046586 A1 3/2005 Hall et al.
2005/0046590 A1 3/2005 Hall et al.
2005/0067159 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0095827 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173128 A1 8/2005 Hall et al.
2005/0212530 A1 9/2005 Hall et al.
2005/0230109 A1 * 10/2005 Kammann et al. ..... 166/255.1
2005/0236160 A1 10/2005 Hall et al.
2005/0274513 A1 * 12/2005 Schultz et al. ..... 166/254.2
2005/0279508 A1 12/2005 Hall et al.
2005/0284659 A1 12/2005 Hall et al.
2005/0284662 A1 12/2005 Hall et al.
2005/0284663 A1 12/2005 Hall et al.
2005/0285645 A1 12/2005 Hall et al.
2005/0285705 A1 12/2005 Hall et al.
2005/0285706 A1 12/2005 Hall et al.
2005/0285751 A1 12/2005 Hall et al.
2005/0285752 A1 12/2005 Hall et al.
2005/0285754 A1 12/2005 Hall et al.

* cited by examiner

PLATFORM FOR ELECTRICALLY COUPLING A COMPONENT TO A DOWNHOLE TRANSMISSION LINE

CROSS REFERENCE TO RELATED APPLICATIONS

The present application is a continuation-in-part of U.S. patent application Ser. No. 11/161,270 filed on Jul. 28, 2005 now abandoned, the entire disclosure of which is incorporated herein by reference.

BACKGROUND

1. Technical Field

This invention relates generally to the field of signal conveyance and, more particularly, to techniques for signal manipulation on transmission lines.

2. Description of Related Art

Due to high costs associated with drilling for hydrocarbons and extracting them from underground formations, efficiency in drilling operations is desirable to keep overall expenses down. Electronic equipment may be useful in drilling operations to accomplish many tasks, such as providing identification information about specific downhole components to surface equipment, performing downhole measurements, collecting downhole data, actuating tools, and other tasks.

Notwithstanding its utility in the drilling process, downhole has proven to be a rather hostile environment for electronic equipment. Temperatures downhole may reach excesses of 200° C. Shock and vibration along a tool string may knock circuitry out of place or damage it. A drilling mud with a high pH is often circulated through a tool string and returned to the surface. The drilling mud and other downhole fluids may also have a detrimental effect on electronic equipment downhole exposed to it.

In the art, a first group of attempts to protect downhole electronics comprises an apparatus with electronic circuitry in a sonde that is lowered into a borehole by a cable periodically throughout the drilling process. The sonde provides protection from downhole conditions to the electronic circuitry placed inside. Examples of this type of protection (among others) may be found in U.S. Pat. No. 3,973,131 to Malone, et al. and U.S. Pat. No. 2,991,364 to Goodman, which are herein incorporated by reference.

A second group comprises adapting downhole tools to accommodate and protect the electronic circuitry. In this manner the electronic circuitry may remain downhole during drilling operations. For example, U.S. Pat. No. 6,759,968 discloses the placement of an RFID device in an O-ring that fills a gap in a joint of two ends of pipe or well-casing. U.S. Pat. No. 4,884,071 to Howard discloses a downhole tool with Hall Effect coupling circuitry located between an outer sleeve and an inner sleeve that form a sealed cavity.

A need remains for improved signal communication, generation, conveyance, and manipulation techniques, particularly in drilling operations.

SUMMARY

One aspect of the invention provides a component platform for a transmission line. The platform includes a unit configured to accept and hold a component. The unit is configured to couple onto a transmission line at a non-end point along the line to link the component to the line. The transmission line is configured to link to a downhole network. The component is configured to affect a signal on the transmission line.

One aspect of the invention provides a component platform for a transmission line. The platform includes a unit configured to accept and hold a component. The unit is configured to couple onto a transmission line, at a non-end point along the line, to link the component to the line. The transmission line is configured for disposal on a tubular configured to link to a downhole network to provide a signal path along a longitudinal axis of the tubular. The component is configured to affect a signal on the transmission line.

One aspect of the invention provides a component platform for a transmission line. The platform includes a unit configured to accept and hold a component. The unit is configured to couple onto a transmission line, at a non-end point along the line, to link the component to the line. The transmission line is configured for disposal on a tubular to provide a signal path along a longitudinal axis of the tubular for communication with a downhole network.

One aspect of the invention provides a method for linking a component to a transmission line. The method includes coupling a unit onto a transmission line at a non-end point along the line, the unit configured to accept and hold a component, to link the component to the line; linking the transmission line to a downhole network; and affecting a signal on the transmission line via the component.

One aspect of the invention provides a method for linking a component to a transmission line. The method includes coupling a unit onto a transmission line at a non-end point along the line, the unit configured to accept and electromagnetically link a component to the line; and disposing the transmission line on a tubular to provide a signal path along a longitudinal axis of the tubular for communication with a downhole network.

It should be understood that for the purposes of this specification the term "integrated circuit" refers to a plurality of electronic components and their connections produced in or on a small piece of material. Examples of integrated circuits include (but are not limited to) circuits produced on semiconductor substrates, printed circuit boards, circuits produced on paper or paper-like substrates, and the like. Similarly, for the purpose of this specification the term "component" refers to a device encompassing circuitry and/or elements (e.g., capacitors, diodes, resistors, inductors, integrated circuits, etc.) typically used in conventional electronics applications.

It should also be understood that for the purposes of this specification the term "protected" refers to a state of being substantially secure from and able to function in spite of potential adverse operating conditions.

BRIEF DESCRIPTION OF THE DRAWINGS

Other aspects and advantages of the invention will become apparent upon reading the following detailed description and upon reference to the drawings in which like elements have been given like numerals and wherein.

DETAILED DESCRIPTION

Figure 1:
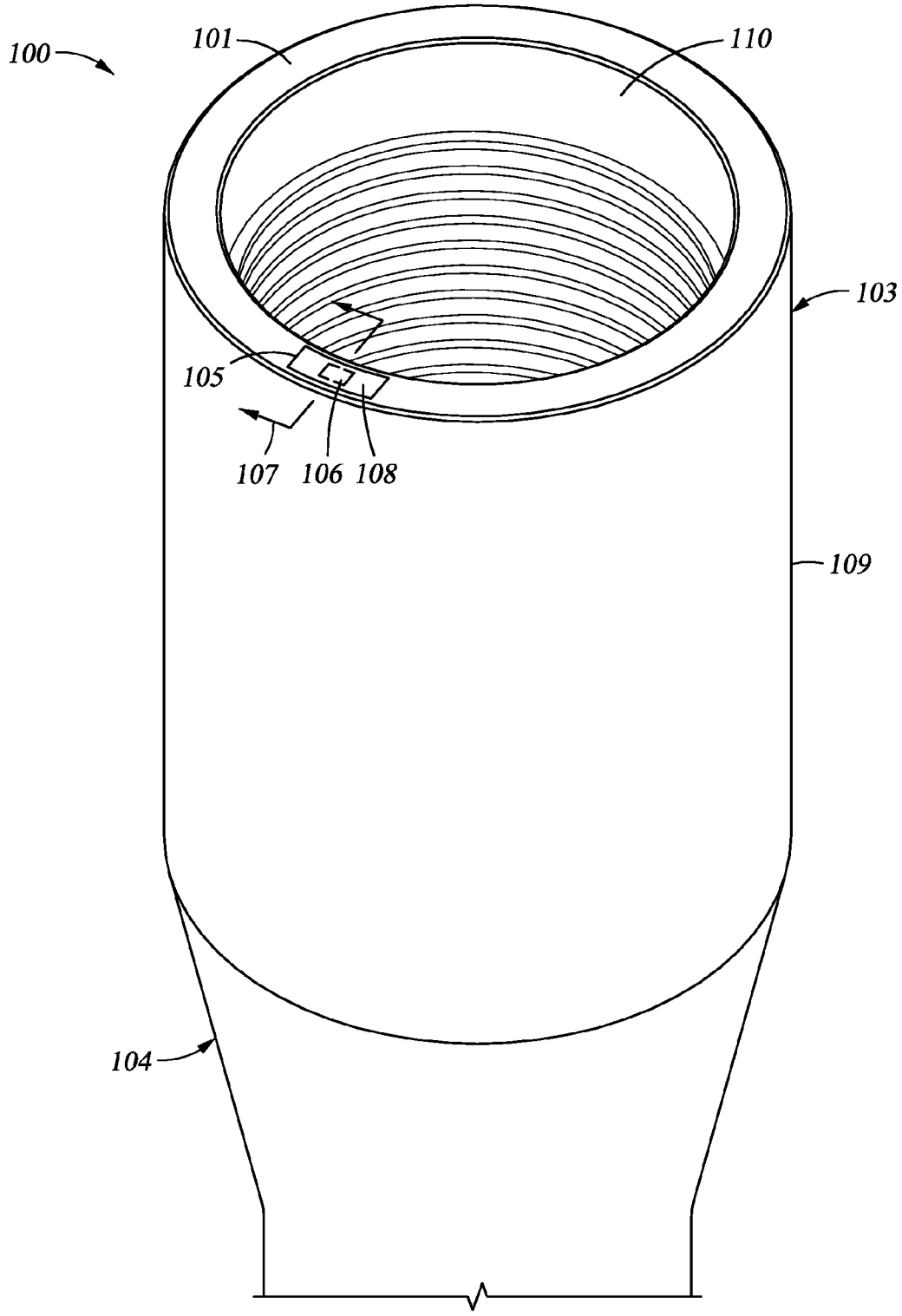
FIG. 1 is a perspective view of a box end of a downhole tool with an integrated circuit in a primary mating surface

Referring to FIG. 1, a portion of a downhole tool 100 according to the present invention is shown. The downhole tool 100 comprises a tubular body 104 that may allow the passage of drilling fluids under pressure through the downhole tool 100. The tubular body 100 has a threaded box end 103, an exterior wall 109 and a bore 110. The box end 103 may be designed to couple to a pin end 203 of another downhole tool 209 (see FIG. 2). The threaded box end 103 may be adapted to create a secure joint between two downhole tools 100, 209 (see FIG. 6).

The box end 103 of the downhole tool 100 comprises a primary mating surface 101, which in the shown embodiment is a primary shoulder. The primary mating surface 101 is intermediate the exterior wall 109 and the bore 110. The primary mating surface 101 is adapted to couple to a primary mating surface 201 in a second downhole tool 209 (see FIG. 6). The primary mating surface 101 comprises a recess 105 in which a component 106 (e.g., an integrated circuit) is disposed. In the embodiment shown, the recess 105 is somewhat rectangular with dimensions proportionate to the physical dimensions of the component 106. In other embodiments, the recess 105 may be an annular groove or have a shape disproportionate to the dimensions of the component 106.

In one aspect of the invention, the component 106 may include a radio frequency identification (RFID) circuit. Preferably, the component 106 is a passive device powered by a received electromagnetic signal. In other words, an interrogation signal received by the component 106 may provide the energy necessary to power the component 106 circuitry. This particular characteristic may be desirable as it may eliminate the need of providing and periodically replacing a power supply for each integrated circuit in a component.

A component 106 comprising RFID circuitry may be desirable for various applications—for instance, the circuitry may store identification information such as a serial number that it may provide to an RFID query device (e.g., a hand-held wand, a fixed RFID interrogator, etc.) upon receiving an interrogating signal.

Figure 5:
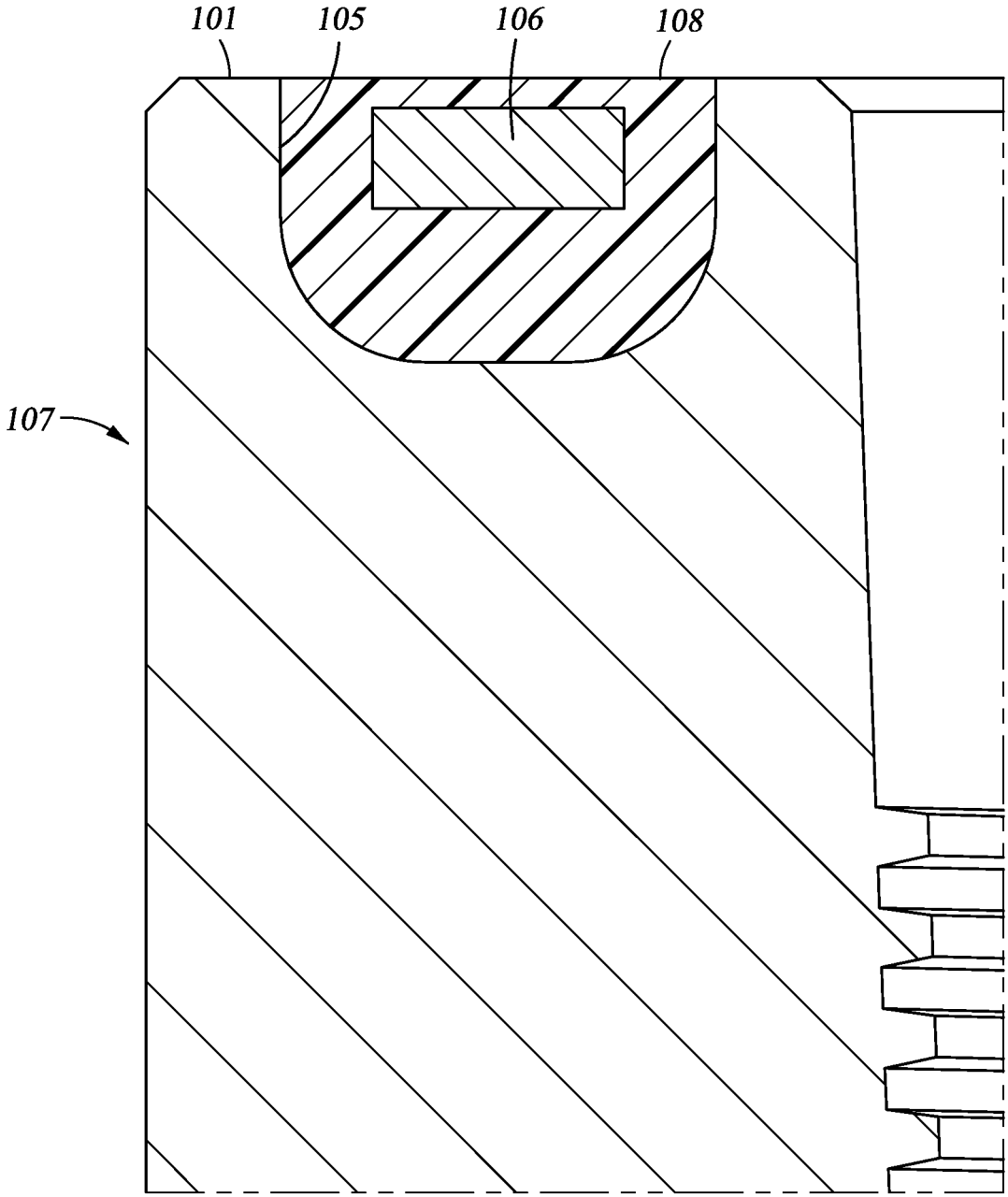
FIG. 5 is a cross-sectional view along line 107 of FIG. 1.

The component 106 may be encapsulated in a protective material 108. The protective material 108 may conform to the dimensions of the recess 105. The protective material 108 may be a permanent potting material such as a hard epoxy material. In other embodiments, the protective material 108 may be a less permanent potting material such as rubber, foam, and the like. The protective material 108 may guard the component 106 from downhole fluids such as drilling mud and oil. When the threaded box end 103 of the downhole tool 100 in this embodiment is coupled to the threaded pin end 203 of another downhole tool 209 (see FIG. 6) in a tool string, the primary mating surface 101 may substantially contact the primary mating surface 201 of the pin end 203 and form an effective mechanical seal, thus providing additional protection to the component 106 from the downhole environment. View 107 is a cross-sectional view of the component 106 and the recess 105 and is depicted in FIG. 5.

Figure 2:
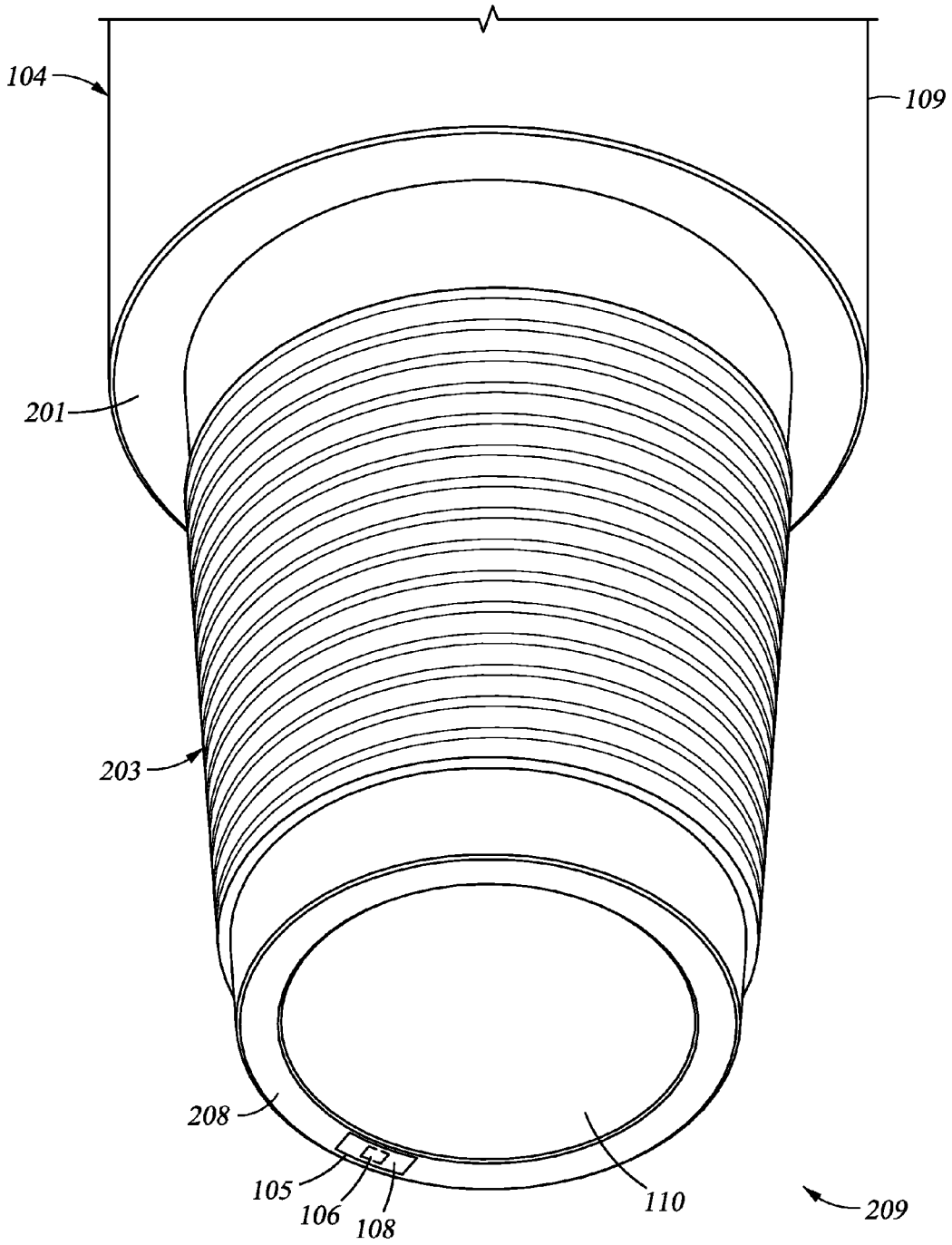
FIG. 2 is a perspective view of a pin end of a downhole tool with an integrated circuit in a secondary mating surface.

Referring now to FIG. 2, a downhole tool 209 with a component 106 is shown. In this embodiment, the downhole tool 209 comprises a threaded pin end 203. The threaded pin end 203 may comprise a primary mating surface 201 and a secondary mating surface 208, both mating surfaces 201, 208 being intermediate the exterior wall 109 and the bore 110. The component 106 may be disposed within a recess 105 in the secondary mating surface 208. The pin end 203 may be designed to couple to the box end 103 of a separate downhole tool 100 through mating threads 202. When this occurs, the secondary mating surface 208 of the pin end 203 may make contact with a secondary mating surface 601 (depicted in FIG. 6) of the box end 103 and form an effective mechanical seal, providing additional protection to the component 106.

Figure 3:
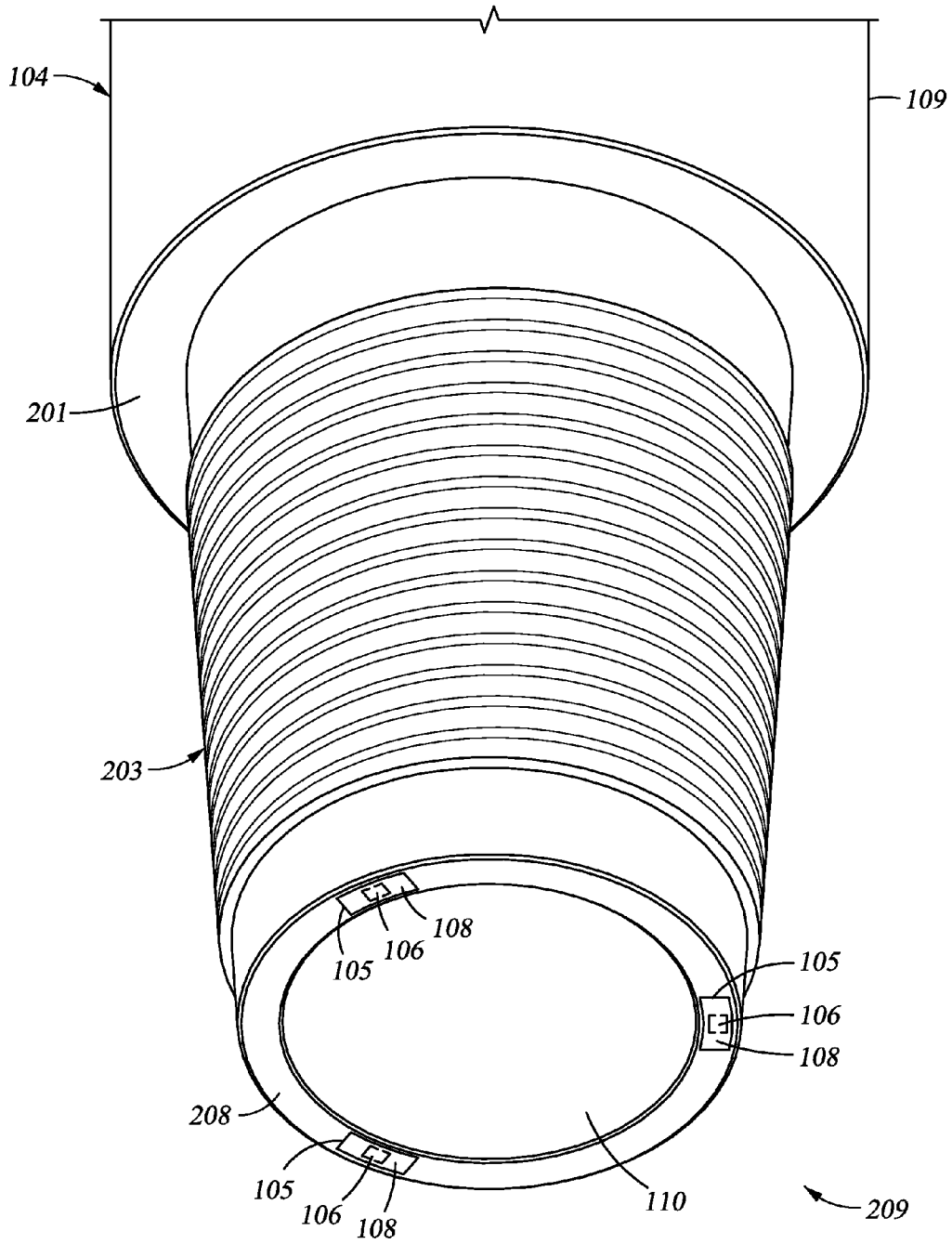
FIG. 3 is a perspective view of a pin end of a downhole tool with a plurality of integrated circuits in a secondary mating surface.

Referring now to FIG. 3, it may be beneficial to have a plurality of components 106 in a downhole tool. For example, if the components 106 are passive RFID devices, they may emit an identification signal modulated with identification data such as a serial number to a receiver. However, due to their passive nature, a plurality of RFID devices configured to emit similar responses may provide a signal that is more easily detected by a receiver than that provided by a single RFID device. A plurality of recesses 105 may be circumferentially distributed along the secondary mating surface 208 to hold the plurality of components 106. In this manner, reception by a short-range RFID receiver may be facilitated for a rotating tool string in which a single component 106 is constantly varying its position with respect to a fixed surface receiver.

Figure 4:
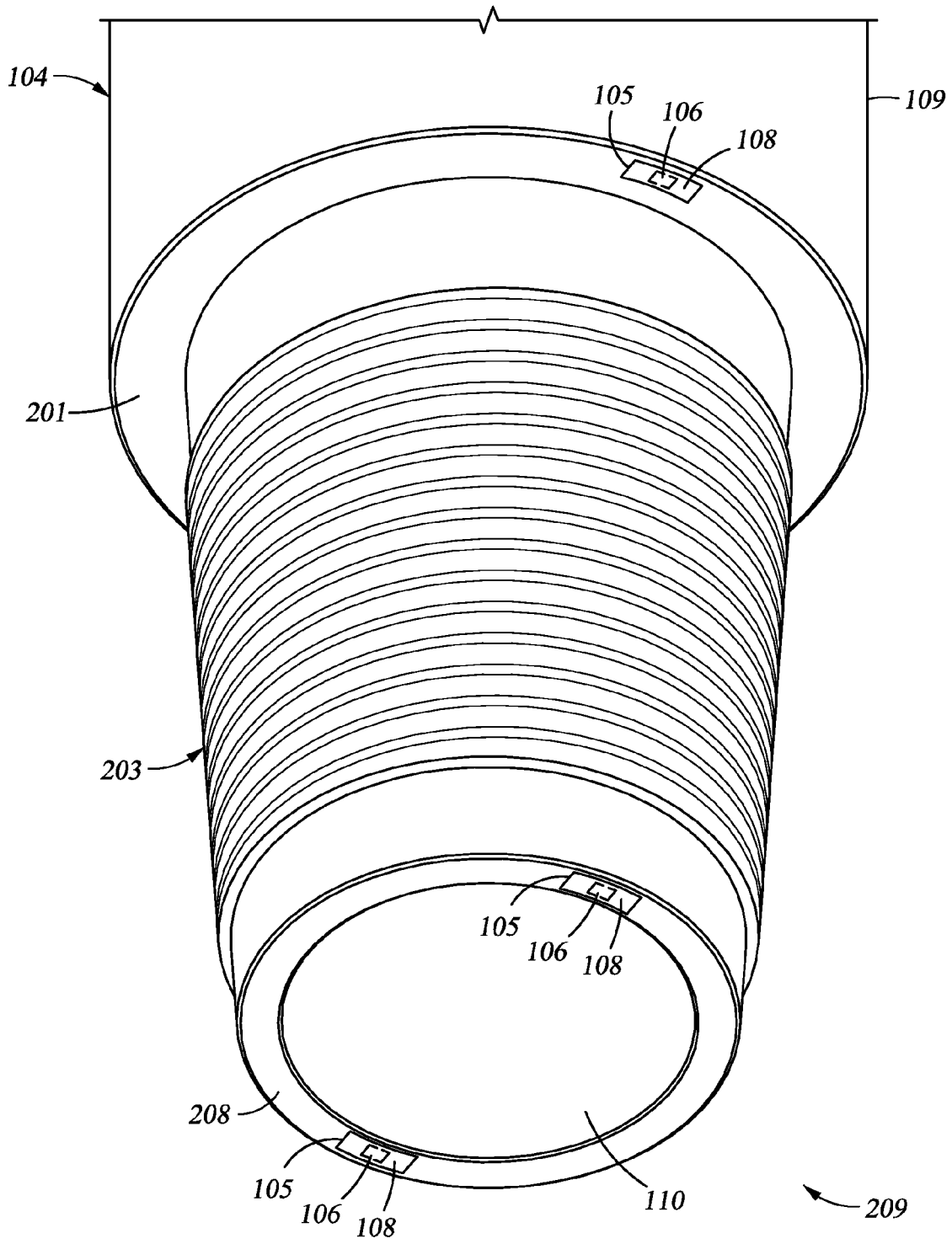
FIG. 4 is a perspective view of a pin end of a downhole tool with integrated circuits in both a primary and a secondary mating surface.

Referring now to FIG. 4, a downhole tool 209 may comprise recesses 105 in both the primary mating surface 201 and the secondary mating surface 208. The recesses 105 may comprise components 106 with various specific applications. Due to the physical characteristics of the components 106 and/or nature of these applications, it may be more advantageous for a component 106 to be located at a specific spot in the downhole tool 209 than in other locations. For instance, a component 106 may be large enough that the recess 105 in which it is disposed affects the structural characteristics of the downhole tool. In cases where several such components 106 are used in the downhole tool 209, it may be beneficial to distribute the components 106 between the primary mating surface 201 and the secondary mating surface 208 in order to minimize the effect on the structural characteristics in the downhole tool 209.

FIG. 5 is a cross-sectional view 107 of the component 106 disposed within the recess 105 of the shoulder 101 shown in FIG. 1. In this particular embodiment, the component 106 is encapsulated in a protective material 108. The protective material 108 may serve a variety of purposes. For example, the protective material 108 may form a chemical bond with the material of the recess 105 and the component 106, serving to fix the component 106 in its position relative to the recess 105. The protective material 108 may also serve as a protection against drilling mud and other downhole fluids such as oil and/or water that may have an adverse effect on the component 106.

In the embodiment shown, the protective material 108 conforms to the dimensions of the recess 105 in order to provide additional structural security in the downhole tool 100 and protection from shocks and jolts to the component 106. The protective material 108 may comprise any of a variety of materials including (but not limited to) epoxies, synthetic plastics, glues, clays, rubbers, foams, potting compounds, Teflon®, PEEK® and similar compounds, ceramics, and the like. For embodiments in which the component 106 comprises RFID circuitry and other applications, the protective material 108 may be magnetically conductive in order to facilitate the transmission of electromagnetic communication to and from the component 106. In some embodiments, it may also be desirable for the protective material 108 to be electrically insulating and/or high-temperature resistant.

The protective material 108 may permanently encapsulate the component 106. Alternatively, the component 106 may be pre-coated with a material such as silicon, an RTV (room temperature vulcanizing) rubber agent, a non-permanent conformal coating material, or other material before encapsulation by the protective material 108 to facilitate its extraction from the protective material 108 at a later time.

Figure 6:
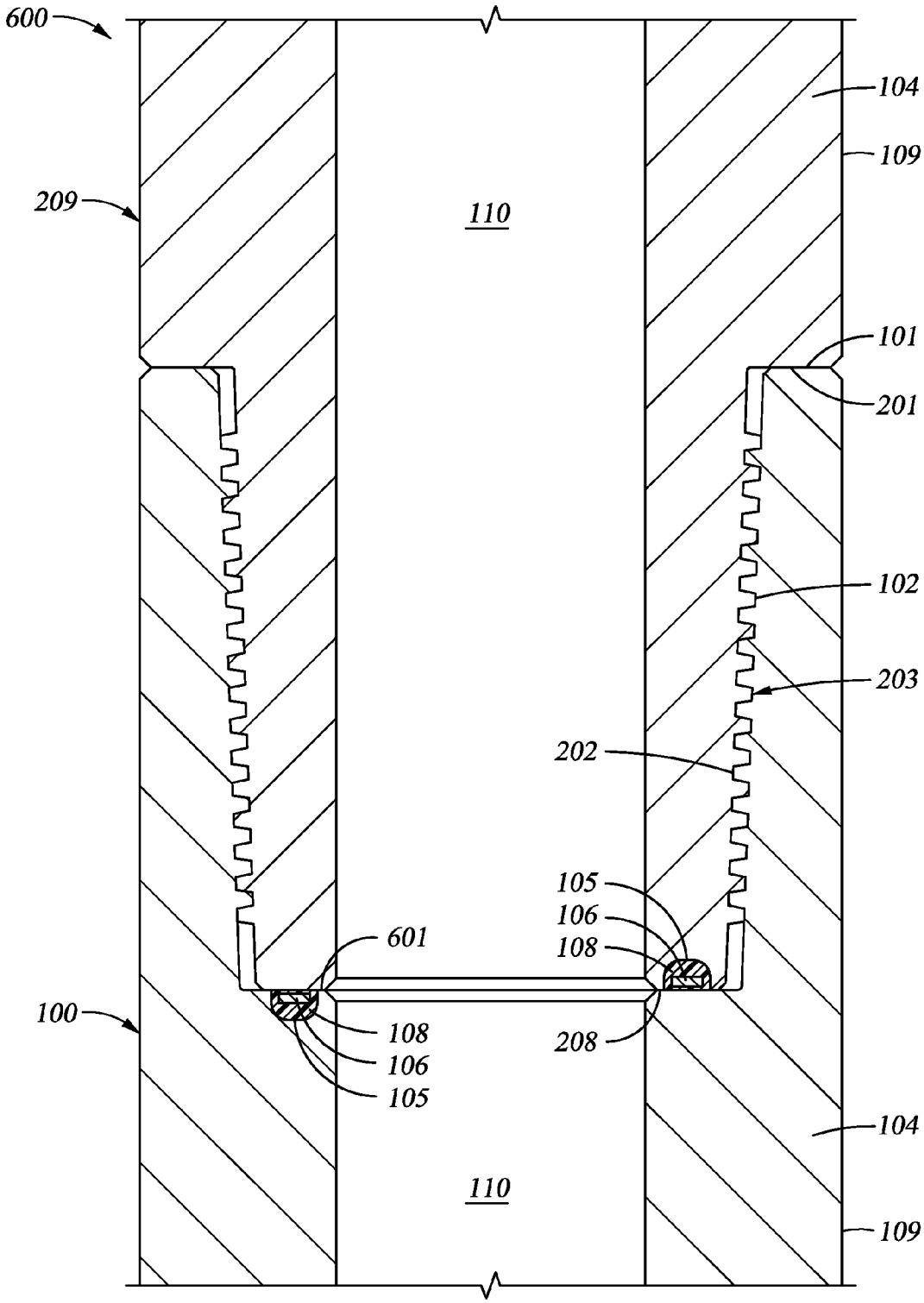
FIG. 6 is a cross-sectional view of a tool joint.

Referring now to FIG. 6, a cross-sectional view of a tool joint 600 comprising the junction of a first downhole tool 100 comprising a threaded box end 103 and a second downhole tool 209 comprising a threaded pin end 203 is shown. The first downhole tool 100 may be joined to the second downhole tool 209 through mated threads 102, 202. The tool joint 600 may comprise the primary mating surface 101 and the secondary mating surface 601 of the first tool 100 being in respective mechanical contact with the primary mating surface 201 and the secondary mating surface 208 of the second tool 209, respectively. Specifically, the contact between secondary mating surfaces 601, 208 may provide a mechanical seal that protects one or more components 106 disposed in recesses 105 therein from fluids, debris and other adverse environmental conditions. The protective material 108 encapsulating the components 106 may be substantially flush with the surface of the secondary mating surface 601, 208 in which they are disposed to create an optimal sealing surface on the secondary mating surfaces 601, 208.

In some embodiments of the invention, measures may be taken to relieve pressure in the recess 105 if drilling mud, lubricants, and other downhole fluids become trapped within the recess 105 as the tool joint 600 is being made up. This high pressure may damage the component 106 or displace it from the recess 105. One means of relieving downhole pressure in the recess 105 is disclosed in U.S. Pat. No. 7,093,654 (assigned to the present assignee and incorporated by reference herein for all that it discloses). The means described in the '654 patent comprises a pressure equalization passageway that permits fluids under pressure in the mating threads 202, 102 of the tool joint 600 to flow between interior and exterior regions of tubular bodies 104 of the downhole tools 100, 209.

Figure 7:
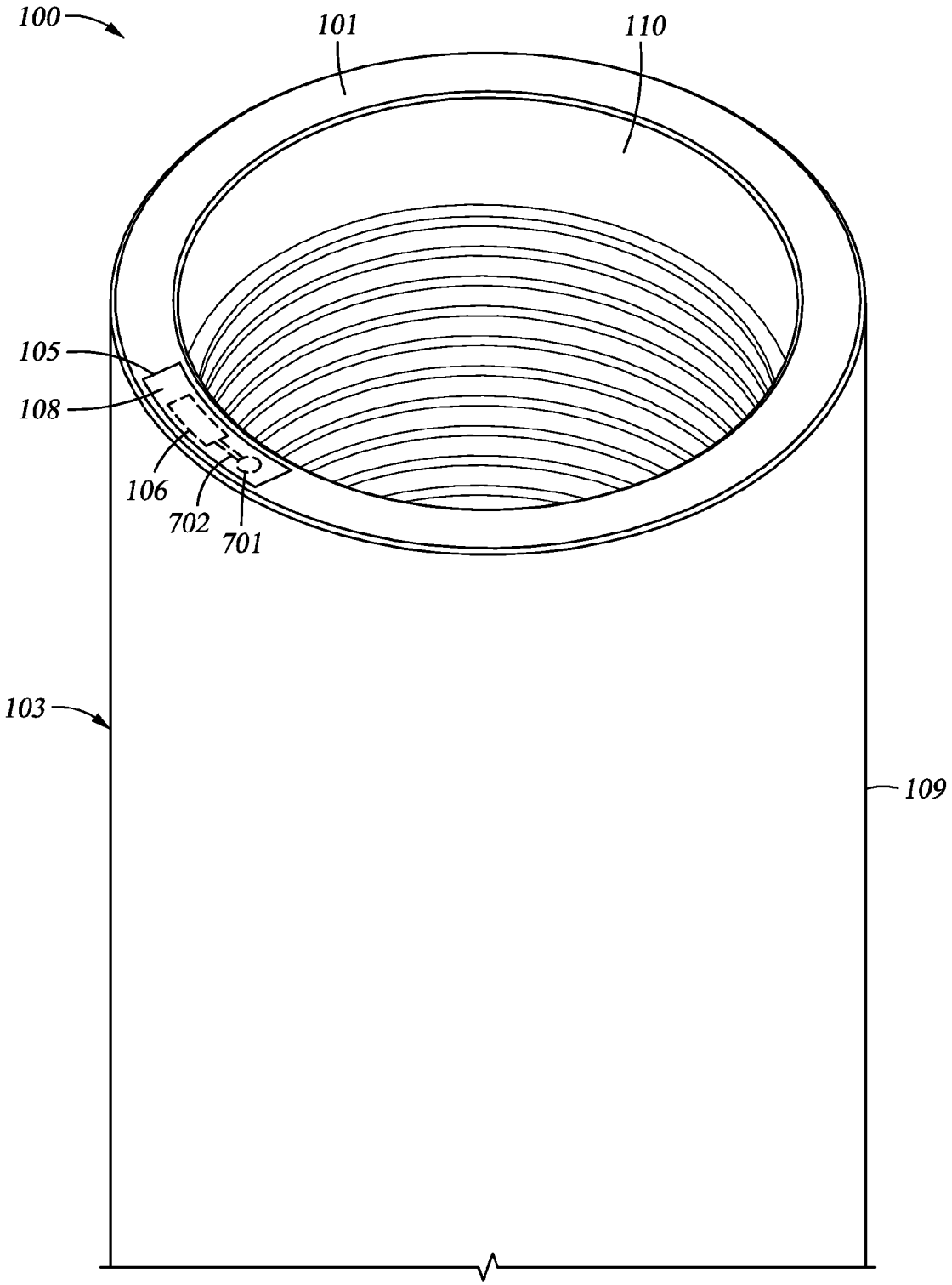
FIG. 7 is a perspective view of a box end of a downhole tool with an integrated circuit and a power supply in a primary mating surface.

Referring now to FIG. 7, a downhole tool 100 may comprise a component 106 with active circuitry disposed within a recess 105 in a primary mating surface 101. Active circuitry requires a power source 701 in order to function properly. In addition to the component 106, the recess 105 may comprise such a power source 701 in electrical communication with the component 106 through a system of one or more electrical conductors 702. One type of usable power source 701 is a battery. Other aspects of the invention may be implemented for distributed power generation and/or storage, localized power delivery, charge, discharge, recharge capability to supply network and network-attached devices. The active circuitry may be, for example, active RFID circuitry capable of receiving interrogating signals and transmitting identification information at greater distances than are possible with purely passive circuitry. The component 106, power source 701, and electrical conductor(s) 702 may all be encapsulated in a protective material 108.

Figure 8:
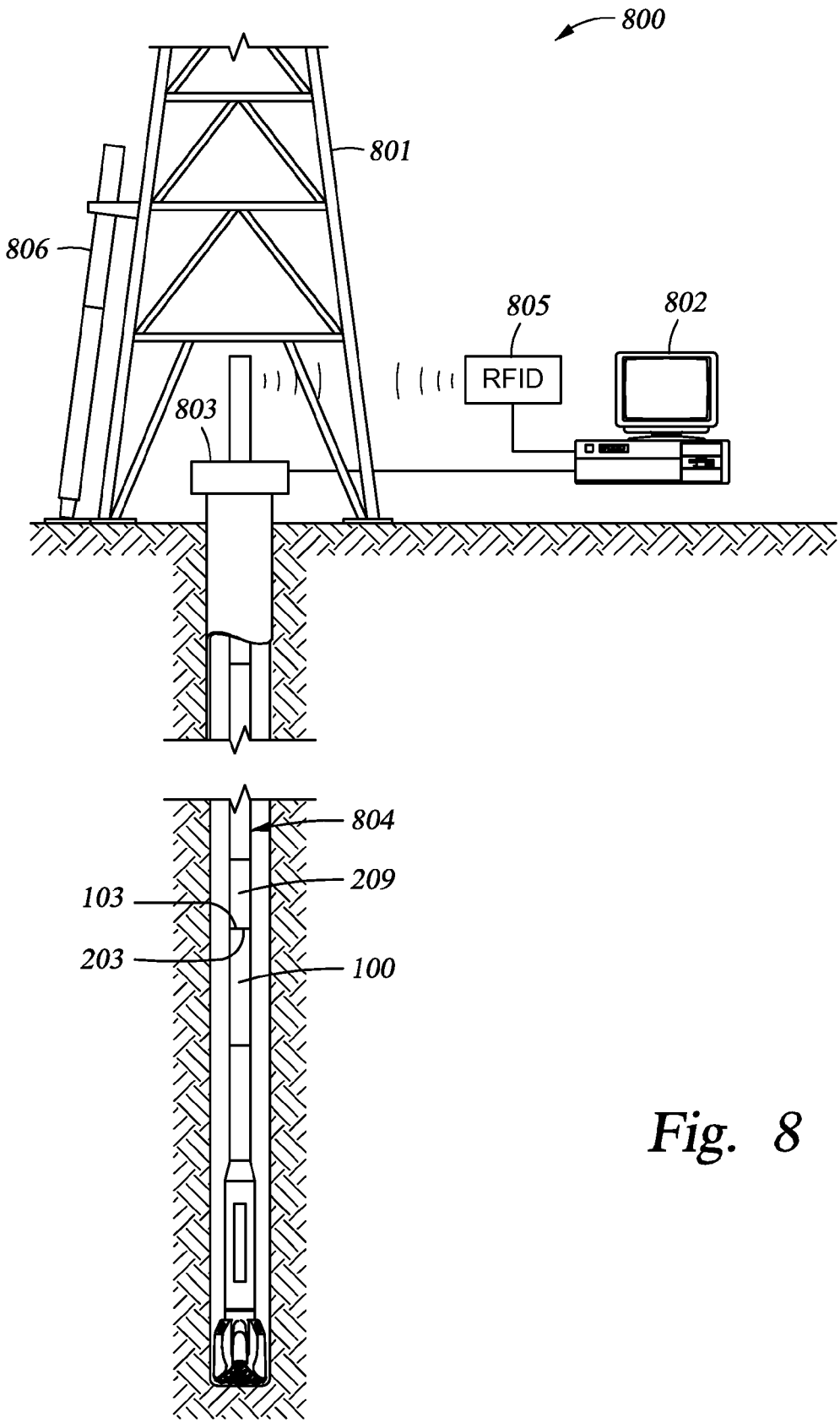
FIG. 8 depicts one embodiment of a downhole network.

Referring now to FIG. 8, the present invention may be implemented in a downhole network 800. The downhole network 800 may comprise a tool string 804 suspended by a derrick 801. The tool string 804 may comprise a plurality of downhole tools 100, 209 of varying sizes connected by mating ends 103, 203. Each downhole tool 100, 209 may be in communication with the rest of the downhole network 800 through a system of inductive couplers.

One preferred system of inductive couplers for downhole data transmission is disclosed in U.S. Pat. No. 6,670,880 (assigned to the present assignee and incorporated by reference herein for all that it discloses). Other means of downhole data communication may be incorporated in the downhole network such as the systems disclosed in U.S. Pat. Nos. 6,688,396 and 6,641,434 to Floerke and Boyle, respectively; which are also herein incorporated by reference for all that they disclose.

A data swivel 803 located at the top of the tool string 804 may provide a communication interface between the rotating tool string 804 and stationary surface equipment 802. In this manner data may be transmitted from the surface equipment 802 through the data swivel 803 and throughout the tool string 804. Alternatively a wireless communication interface may be used between the tool string 804 and the surface equipment 802. In the embodiment shown, an RFID transmitter/receiver apparatus 805 is located at the surface and may query RFID circuitry in downhole tools 100, 209 as they are added to or removed from the tool string 804. In this way, an accurate record of which specific tools make up the tool string 804 at any time may be maintained. Also, if a communications problem were traced to a specific downhole tool 100, 209 in the tool string 804, identification information received by the RFID transmitter/receiver apparatus 805 may be used in a database to access specific information about the faulty tool downhole 100, 209 and help resolve the problem. The RFID transmitter/receiver apparatus 805 may be in communication with the surface equipment 802 or may be an independent entity.

In other embodiments, the surface equipment 802 may not need the RFID transmitter/receiver 805 to communicate with the circuitry disposed within the downhole tools 100, 209. The surface equipment 802 may be equipped to send a query directly through wired downhole tools 100, 209 in the network 800 to RFID circuitry as will be discussed in more detail in the description of FIG. 16. In other embodiments still, downhole tools 806 that are not connected to the network 800 may be queried by an RFID query device such as a wand (not shown) and relay identification information stored in a component 106 comprising RFID circuitry.

Figure 9:
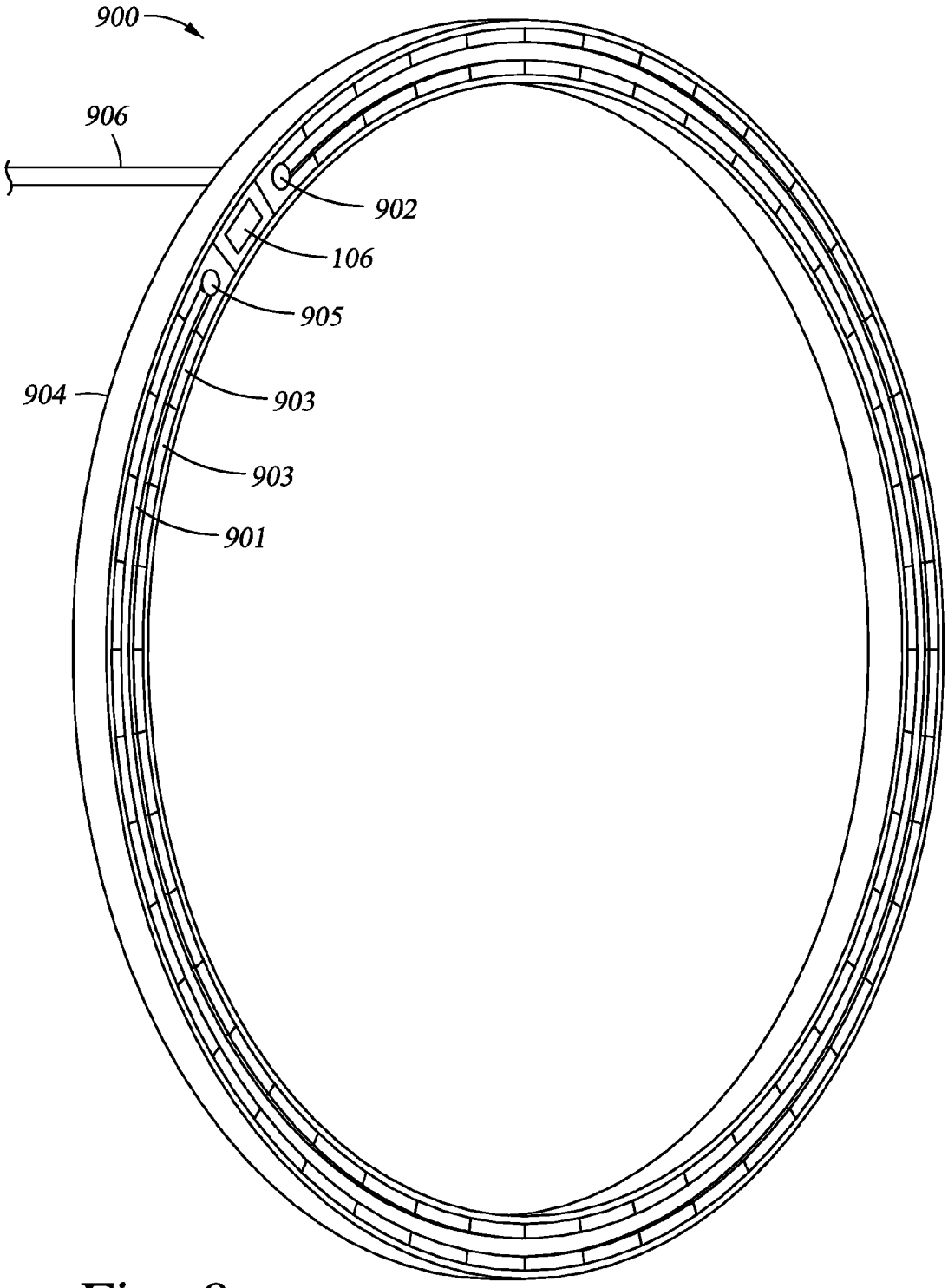
FIG. 9 is a perspective view of an inductive coupler and an integrated circuit consistent with the present invention.

Referring now to FIG. 9, an inductive coupler 900 designed to be disposed in the recess 105 of a downhole tool shoulder is depicted. In this embodiment the recess 105 is an annular groove designed to house both the inductive coupler 900 and the component 106 (shown in FIG. 10). The inductive coupler 900 is substantially similar to the inductive coupler disclosed in U.S. Pat. No. 6,670,880 with the addition of a component 106. The inductive coupler 900 comprises an electrically conducting coil 901 lying in a magnetically conductive electrically insulating trough 1101 (see FIG. 11). The electrically conducting coil 901 is shown as a single-turn coil of an electrically conducting material such as a metal wire; however, in other embodiments the electrically conducting coil 901 comprises multiple turns. The magnetically conductive electrically insulating trough may comprise a plurality of U-shaped fragments 903 arranged to form a trough around the electrically conducting coil 901. A preferred magnetically conductive electrically insulating material is ferrite, although several materials such as nickel or iron based compounds, mixtures, and alloys, mu-metals, molypermalloys, and metal powder suspended in an electrically-insulating material may also be used. A data signal may be transmitted from an electrical conductor 906 to a first point 902 of the electrically conducting coil 901 from which it flows through the electrically conducting coil 901 to a second point 905 which is preferably connected to ground.

When a first inductive coupler 900 is mated to a second similar inductive coupler 900, magnetic flux passes from the first magnetically conductive electrically insulating trough to the second magnetically conductive electrically insulating trough according to the data signal in the first electrically conducting coil 901 and induces a similar data signal in the second electrically conducting coil 901.

The inductive coupler 900 comprises a component 106. In one aspect wherein the component 106 includes an RFID circuit, the component may comprise an active RFID tag, a passive RFID tag, low-frequency RFID circuitry, high-frequency RFID circuitry, ultra-high frequency RFID circuitry, and combinations thereof. The component 106 may be located in a gap between the first point 902 and the second point 905 of the electrically conducting coil 901. The component 106, electrically conducting coil 901, and U-shaped fragments 903 may be encapsulated within a protective material 108 as disclosed in the description of FIG. 5. The inductive coupler 900 may further comprise a housing 904 configured to fit into the recess 105 of the downhole tool shoulder.

The component 106 may be in electromagnetic communication with the electrically conducting coil 901 due to their close proximity to each other. In one aspect of the invention, the electrically conducting coil 901 may act as a very short-range radio antenna and transmit a signal that may be detected by RFID circuitry in the component 106. Likewise, an identification signal transmitted by RFID circuitry in the component 106 may be detected by the electrically conducting coil 901 and transmitted throughout a downhole network 800. In this manner, surface equipment 802 and other network devices may communicate with the component 106. Signals received from the component 106 in the electrically conducting coil 901 of the inductive coupler 900 may require amplification by repeaters (not shown) situated along the downhole network 800.

Figure 10:
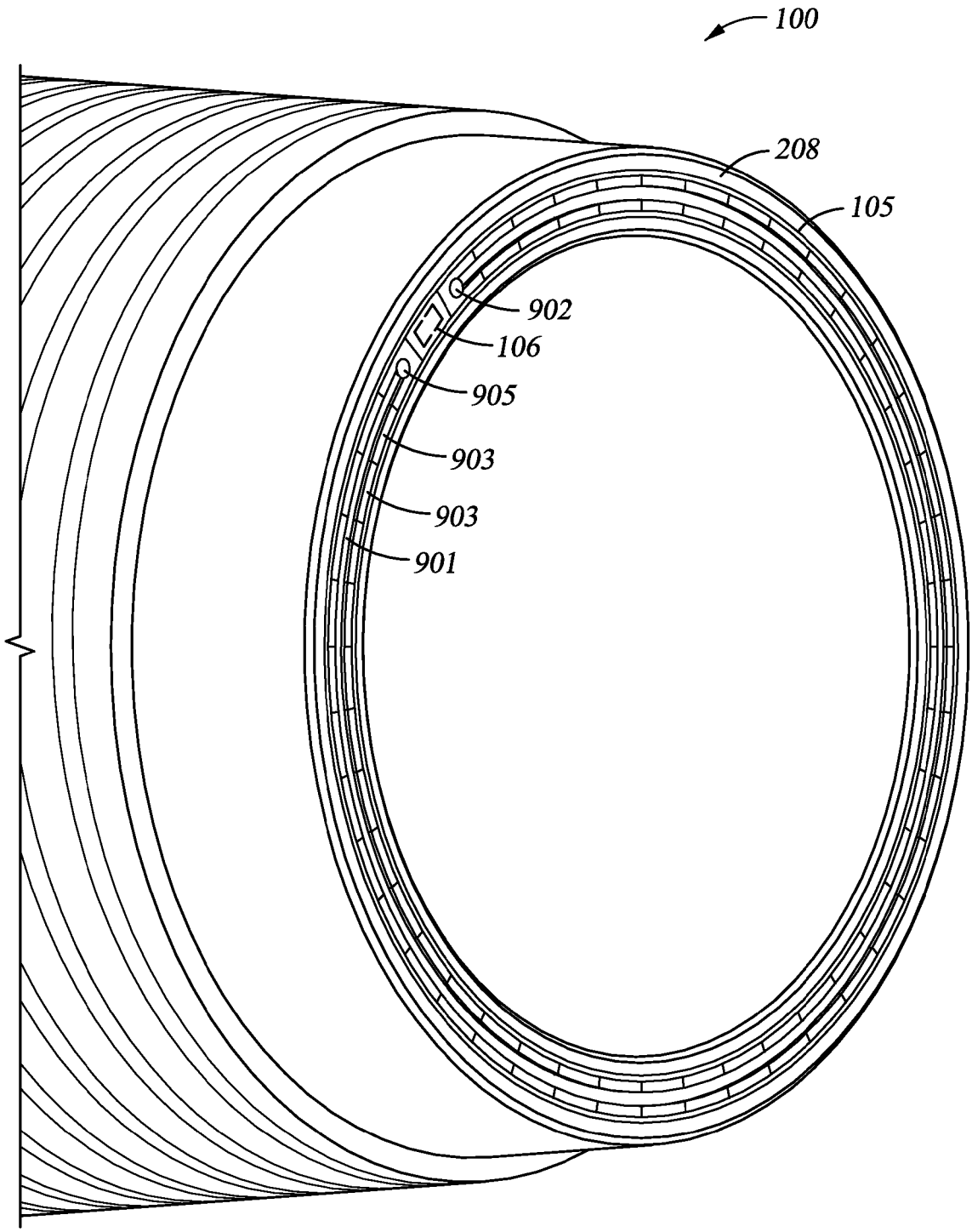
FIG. 10 is a perspective view of a pin end of a downhole tool with the inductive coupler and integrated circuit of FIG. 9 disposed within a groove.

Referring now to FIG. 10, a downhole tool 100 is shown with the inductive coupler 900 of FIG. 9 disposed in a recess 105 of a secondary mating surface 208. In this embodiment, the recess 105 is an annular groove. The inductive coupler 900 may be configured to mate with a second inductive coupler in a secondary mating surface 601 of a box end 103.

Figure 11:
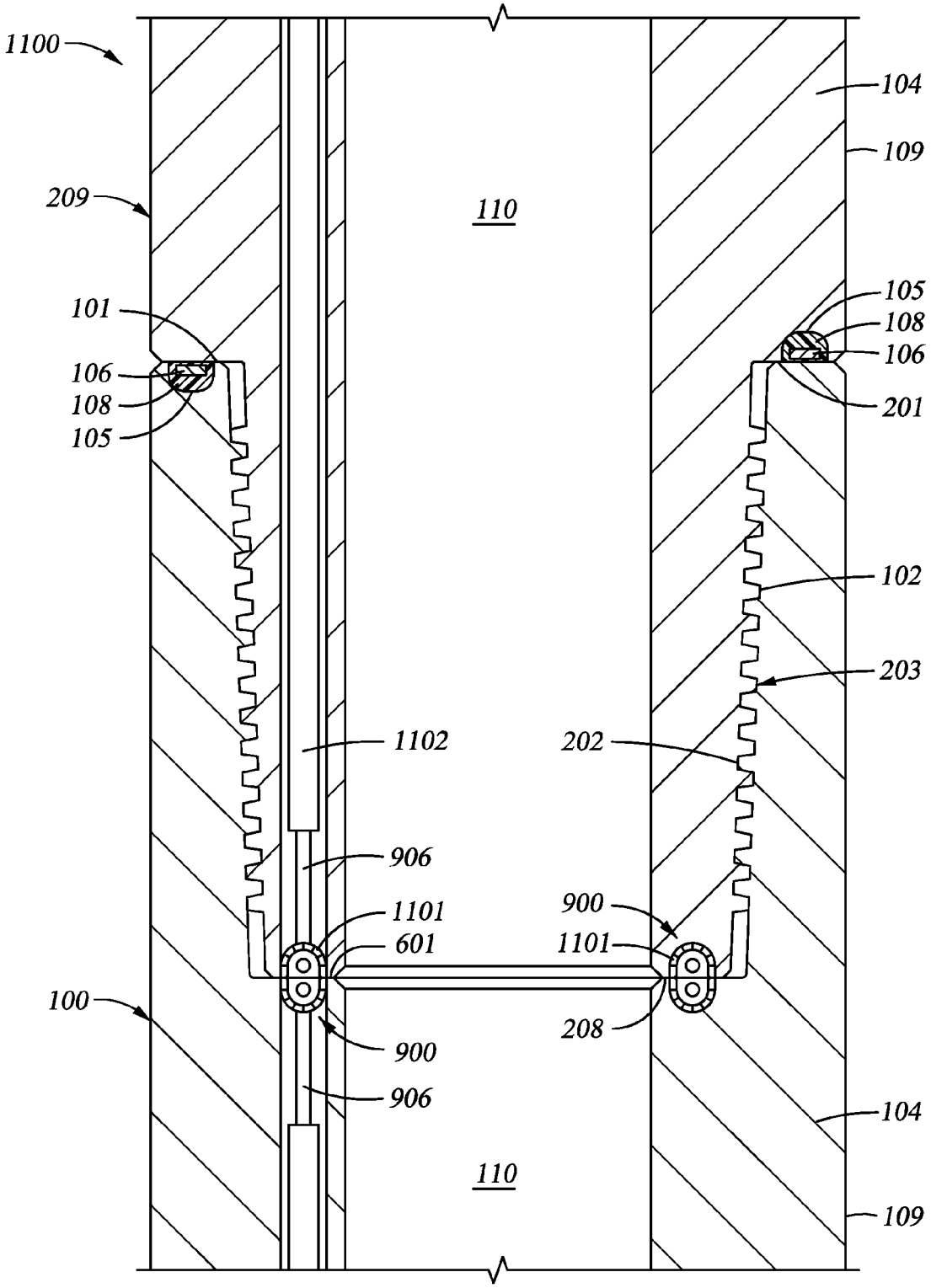
FIG. 11 is a cross-sectional view of a tool joint with inductive couplers in the secondary mating surfaces of the downhole tools and integrated circuits in the primary mating surfaces of the downhole tools.

Referring now to FIG. 11, a cross-sectional view of a tool joint 1100 comprising the junction of a first downhole tool 100 and a second downhole tool 209 is shown. Each tool 100, 209 comprises both an inductive coupler 900 in a secondary mating surface 601, 208 and a component 106 disposed within the recess 105 of a primary mating surface 101, 201. Both inductive couplers 900 may be in close enough proximity to transfer data and/or power across the tool joint 1100. Both inductive couplers 900 may be lying in magnetically conductive, electrically insulating troughs 1101. Data or power signals may be transmitted from an inductive coupler 900 in one end of a downhole tool 100, 209 to an inductive coupler 900 in another end by means of the electrical conductor 906 in the inductive coupler 900. This electrical conductor 906 may be electrically connected to an inner conductor of a coaxial cable 1102. Mechanical seals created by the junction of primary mating surfaces 101, 201 and secondary mating surfaces 601, 208 may protect both the inductive couplers 900 and the components 106 from downhole conditions.

Figure 12:
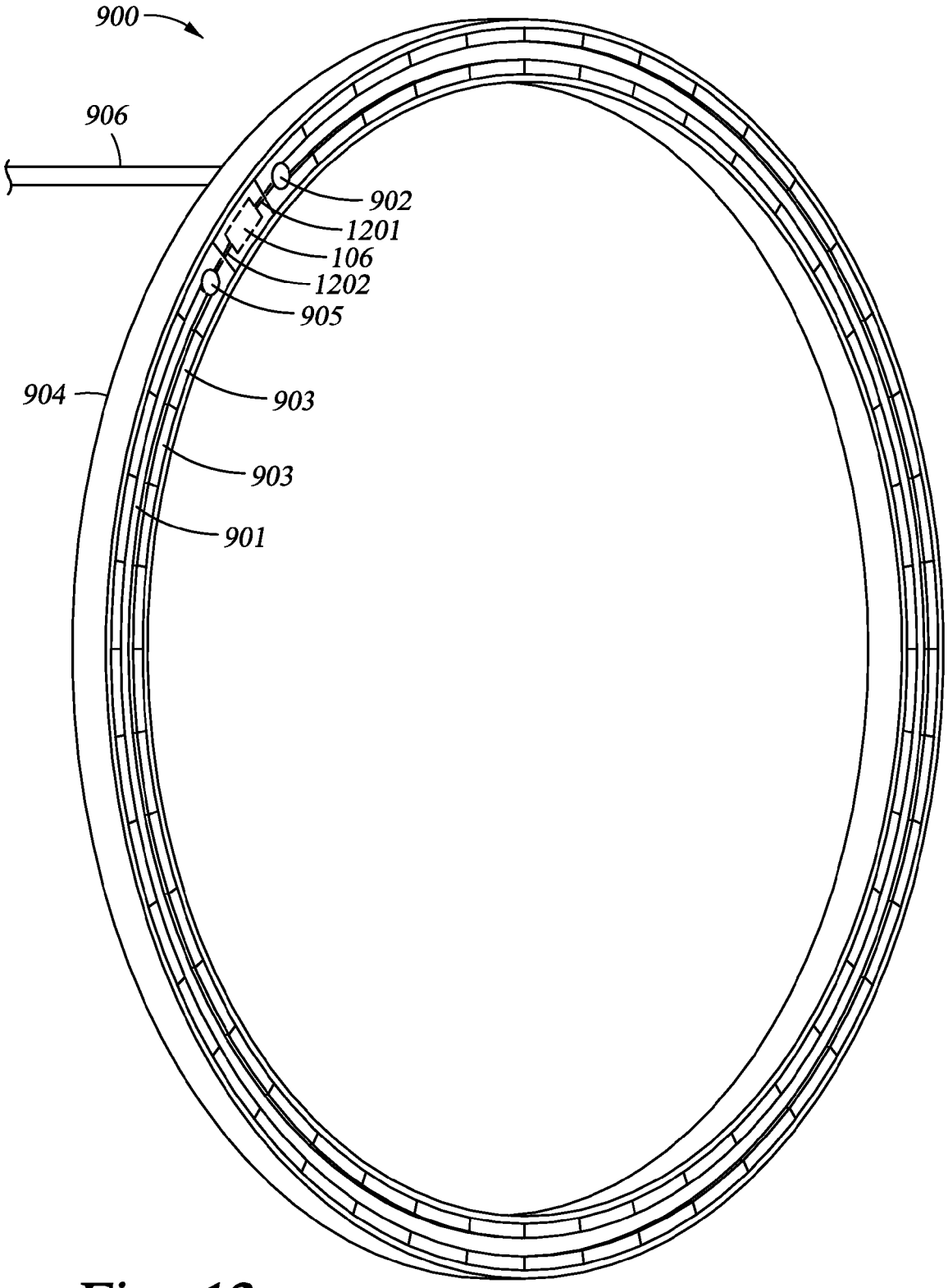
FIG. 12 is a perspective view of another embodiment of an inductive coupler and an integrated circuit consistent with the present invention.

Referring now to FIG. 12, another embodiment of an inductive coupler 900 according to the invention may comprise a component 106 in direct electrical contact with the electrically conducting coil 901 through electrical conductor 1201. The component 106 may further be in electrical communication with ground through electrical conductor 1202. In one aspect, the component 106 may comprise passive RFID circuitry that requires a connection to an external antenna in order to receive and transmit RF signals. The electrically conducting coil 901 may function as that antenna. Through the downhole network 800, the RFID transmitter/receiver 805 of the surface equipment 802 may be in electromagnetic communication with the component 106.

Figure 13:
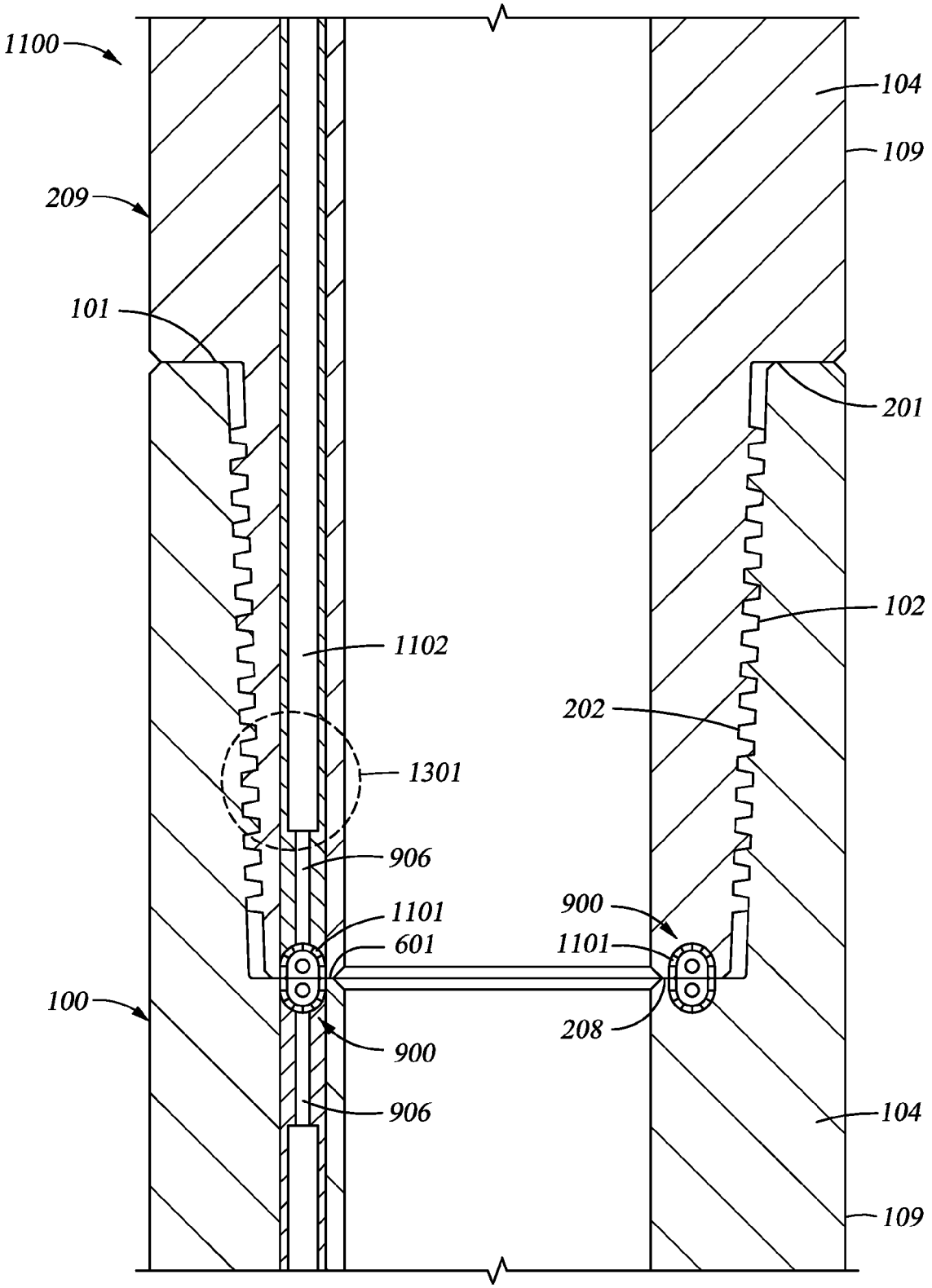
FIG. 13 is a cross-sectional view of tool joint with inductive couplers in the secondary mating surfaces of the downhole tools.
Figure 14:
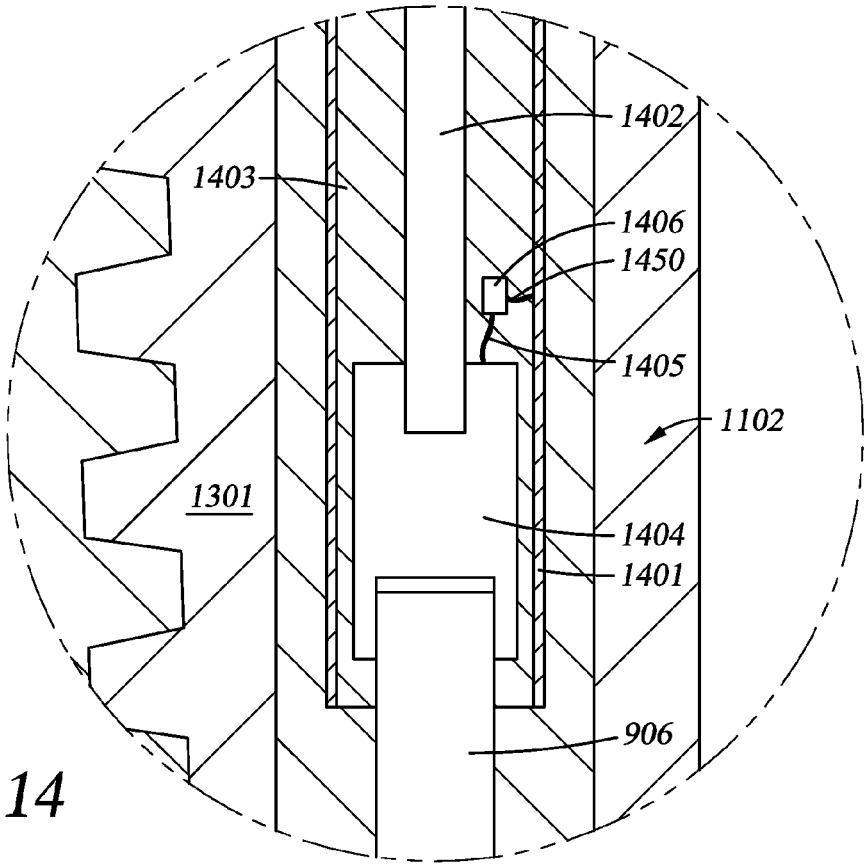
FIG. 14 is a detailed view of FIG. 13.

Referring now to FIGS. 13 and 14, a cross-sectional view of another embodiment of a tool joint 1100 is shown. Tools 100, 209 may be connected to the downhole network 800 through inductive couplers 900 and coaxial cable 1102. As is shown in FIG. 8, the downhole network 800 may comprise surface equipment 802 comprising an RFID transmitter/receiver 805 configured with RFID interrogating circuitry.

Tool 209 may comprise a component (e.g., an integrated RFID circuit 1406). FIG. 14 shows a detailed view 1301 of FIG. 13. The coaxial cable 1102 may comprise an outer conductor 1401 and an inner conductor 1402 separated by a dielectric 1403. The inner conductor 1402 may be in electrical communication with the electrical conductor 906 of the inductive coupler 900 through connector 1404. The outer conductor 1401 may be in electrical communication with ground. In some embodiments, the outer conductor 1401 may also be in electrical communication with the tubular body 104 of the downhole tool 100 thus setting its potential at ground and providing access to a node with a ground potential for the inductive coupler 900.

Still referring to FIG. 14, a protected RFID integrated circuit 1406 component is shown comprising a first electrical connection 1405 to electrical conductor 906 of the inductive coupler 900 (See FIG. 9) through connector 1404. Integrated circuit 1406 may also comprise a second electrical connection 1450 to ground through the outer conductor 1404. In other embodiments, the RFID integrated circuit 1406 component may be located between the coaxial cable 1102 and the inductive coupler 900. These locations may be particularly advantageous in providing a substantially protected environment from downhole operating conditions. In any location, the component 1406 may comprise connections 1405 to ground and inductive coupler 900. In this manner, the component 1406 may utilize the inductive coupler 900 as an external antenna (see description of FIGS. 13, 15). Through the downhole network 800, the RFID transmitter/receiver 805 of the surface equipment 802 may be in electromagnetic communication with the component 1406.

In other embodiments of the invention, a direct electrical contact coupler or a hybrid inductive/electrical coupler such as is disclosed in U.S. Pat. No. 6,641,434 to Boyle, et al may be substituted for the inductive coupler 900. U.S. Pat. No. 6,929,493 (assigned to the present assignee and entirely incorporated herein by reference) also discloses a direct connect system compatible with the present invention.

Figure 15:
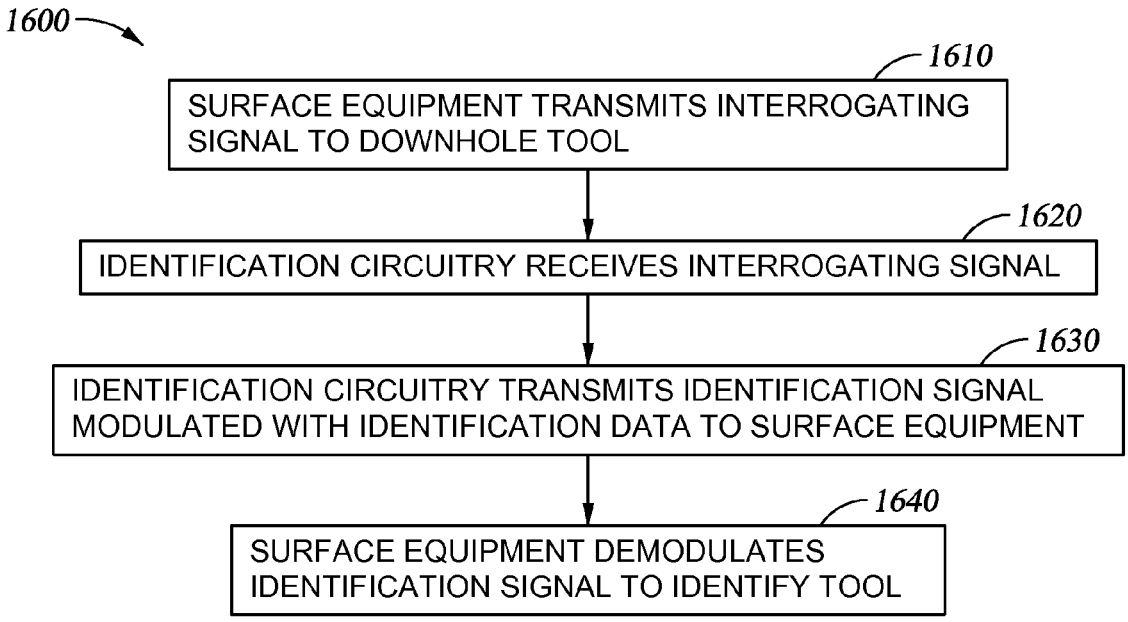
FIG. 15 is a flowchart illustrating a method for identifying a tool in a downhole tool string.

Referring now to FIG. 15, a method 1600 for identifying a downhole tool 100 in a tool string 804 is depicted. The method 1600 comprises the steps of transmitting 1610 an interrogating signal from surface equipment 802 to the downhole tool 100 and receiving 1620 the interrogating signal in identification circuitry disposed within a shoulder of the downhole tool 100. The interrogating signal may be an electromagnetic signal transmitted through a downhole network 800 and the identification circuitry may be a component 106 configured with suitable circuitry. The identification circuitry may further comprise RFID circuitry.

The RFID interrogation signals may be transmitted at first frequency while network data is transmitted at second frequency. In selected embodiments, a first series of RFIDs may respond to interrogation signals on a first frequency, while a second series of RFIDs may respond to interrogation signals on a second frequency. For example, it may be desirable to identify all of the downhole tools comprising network nodes. An interrogation signal may be sent on a frequency specific for those tools comprising network nodes and other RFIDs in communication with the downhole network will not respond.

The method 1600 further comprises the steps of transmitting 1630 an identification signal modulated with identification data from the identification circuitry to the surface equipment 802 and demodulating 1640 the identification data from the identification signal to identify the downhole tool 100. The identification data may be a serial number.

Figure 16:
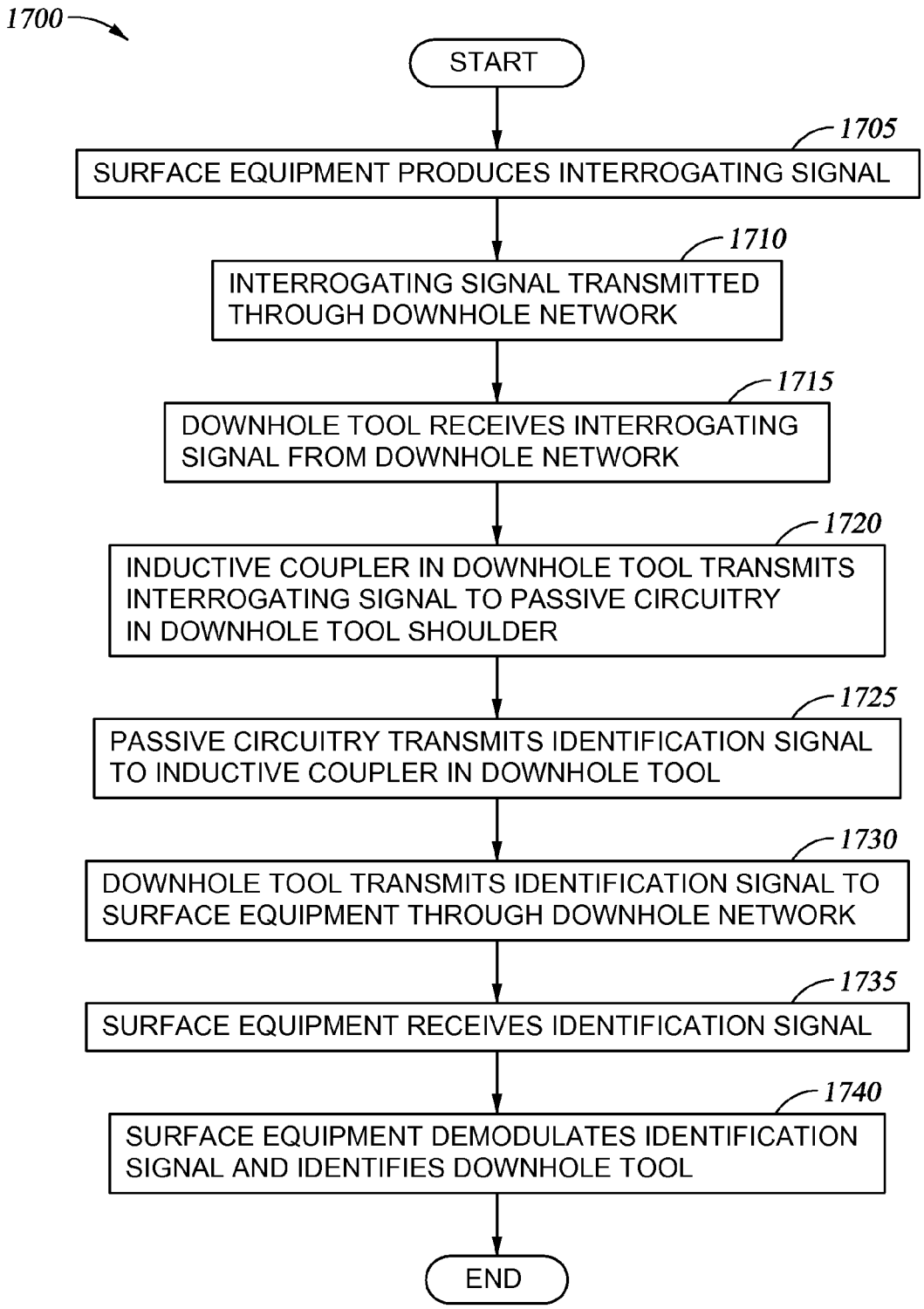
FIG. 16 is a flowchart illustrating a more detailed method for identifying a tool in a downhole tool string.

Referring now to FIG. 16, a more detailed method 1700 for identifying a downhole tool 100 in a tool string 804 is illustrated. The method 1700 comprises the steps of surface equipment 802 producing 1705 an interrogating signal and the interrogating signal being transmitted 1710 through a downhole network 800. The interrogating signal may be an electromagnetic signal at a predetermined frequency and amplitude for a predetermined amount of time. The parameters of frequency, amplitude, and signal length may be predetermined according to characteristics of one or more components 106 in one or more downhole tools 100. The downhole network 800 may comprise a downhole data transmission system such as that of the previously referenced '880 patent.

The method 1700 further comprises the downhole tool 100 receiving 1715 the interrogating signal from the downhole network 800 and transmitting 1720 the interrogating signal from an inductive coupler 900 to a component 106 in a shoulder of the downhole tool 100 comprising passive circuitry. In one aspect, the passive circuitry is preferably an integrated circuit that comprises RFID capabilities. The downhole tool 100 may receive 1715 the interrogating signal in the inductive coupler 900. The inductive coupler 900 may communicate wirelessly with the component 106 through an internal antenna in the passive circuitry. In other embodiments, the inductive coupler 900 may act as an external antenna for the component 106 and communicate with it through direct electrical communication. The component 106 may then transmit 1725 an identification signal to the inductive coupler 900 in the downhole tool 100. The identification signal may comprise identification information such as a serial number modulated on a sinusoidal electromagnetic signal.

The method further comprises the downhole tool 100 transmitting 1730 the identification signal to the surface equipment 802 through the downhole network 800. The surface equipment 802 may receive 1735 the identification signal from the downhole network 800 and demodulate 1740 the identification signal to retrieve the identification information and identify the downhole tool 100. The identification information on the identification signal may then permit the surface equipment 802 to access a database or other form of records to obtain information about the downhole tool 100.

Figure 17:
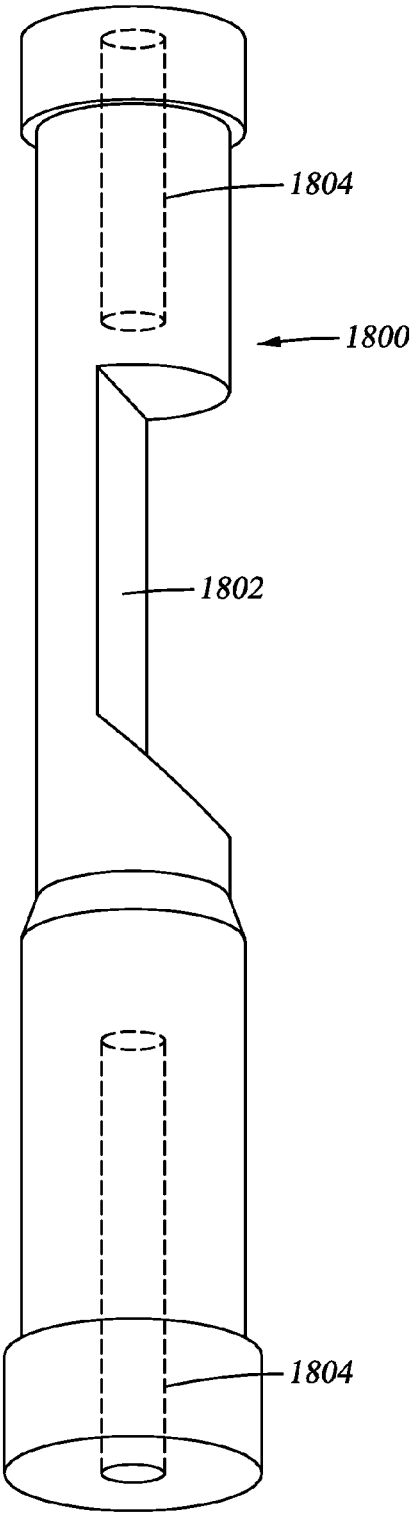
FIG. 17 is a schematic of a component platform consistent with the present invention.

Aspects of the invention also include platforms for holding and linking components 106 to a transmission line. Placement of components away from the mating junction or end point of a tool/tubular provides protection for the component and offers additional advantages such as greater manufacturing flexibility. FIG. 17 shows an embodiment of a component 106 platform 1800 of the invention. In one aspect, the platform 1800 comprises a cylindrical-shaped unit having a cavity or recess 1802 formed therein. Platform 1800 aspects of the invention may be configured in any suitable shape and in various dimensions depending on the particular implementation. However, it will be appreciated by those skilled in the art that platform 1800 implementations for use with transmission lines disposed in small and confined conduits (e.g., the walls in a tubular) require substantial miniaturization of the assemblies. Platform 1800 aspects of the invention may be made of any suitable conductive material, insulating material, or combinations thereof. In the aspect shown in FIG. 17, the platform 1800 is made of a suitable conductive material (e.g., metal). The platform 1800 includes voids or channels 1804 formed at each end of the unit. The platform 1800 may be manufactured using any techniques as known in the art, such as machining or die-cast processes.

Figure 18:
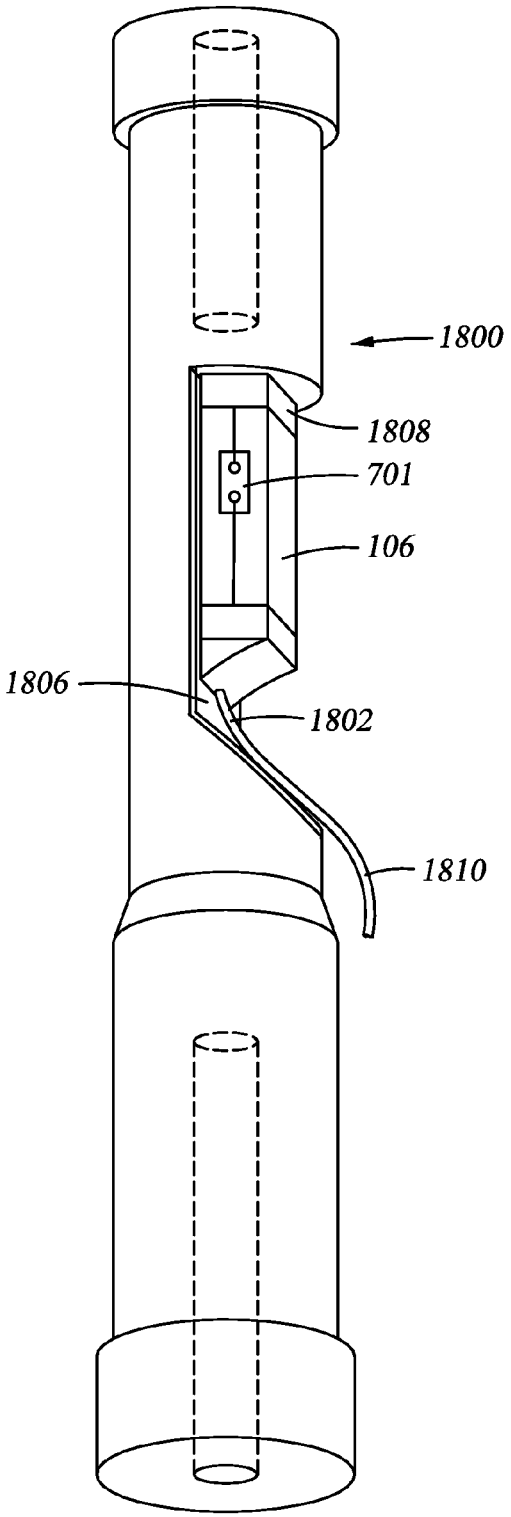
FIG. 18 is a schematic of a component disposed on a component platform consistent with the present invention.

A desired component 106 is mounted in the recess 1802, as shown in FIG. 18. An insulating material is placed between the component 106 and the recess 1802 surface to form a non-conductive or insulating barrier 1806. Suitable conventional materials may be used to form the barrier 1806, including heat-shrink tubing, insulating compounds, non-conductive films, etc. The component 106 is mounted in the recess 1802 to form an electrical junction 1808 with the platform 1800. The electrical junction 1808 may be formed by any suitable means known in the art (e.g., any die attach method, wirebonding, wire leads, flex circuit, connectors, brazing, welding, press fit, electrical contact, solder, conductive adhesive, conductor leads, etc.). A linking element 1810 extends from an end of the component 106 to provide another connection point. The linking element 1810 can be affixed to the component 106 via any suitable means as known in the art (e.g., any die attach method, wirebonding, wire leads, flex circuit, connectors, brazing, welding, press fit, electrical contact, solder, conductive adhesive, conductor leads, etc.). In one aspect, the linking element 1810 consists of a flexible circuit with a conductive trace embedded therein. In some aspects, the linking element 1810 is part of a pre-formed component 106. In yet other aspects, the component 106 may be implemented with integral pins, or other types of contact points, configured to mesh with appropriate receptacles or contacts formed on the platform 1800 (e.g., microchip with connector pins) (not shown). When implemented with an active component 106, a power source 701 (e.g., battery) may be linked to the component via any suitable means known in the art. The aspect shown in FIG. 18 comprises a power source 701 disposed in the recess 1802 along with the component 106.

Figure 19:
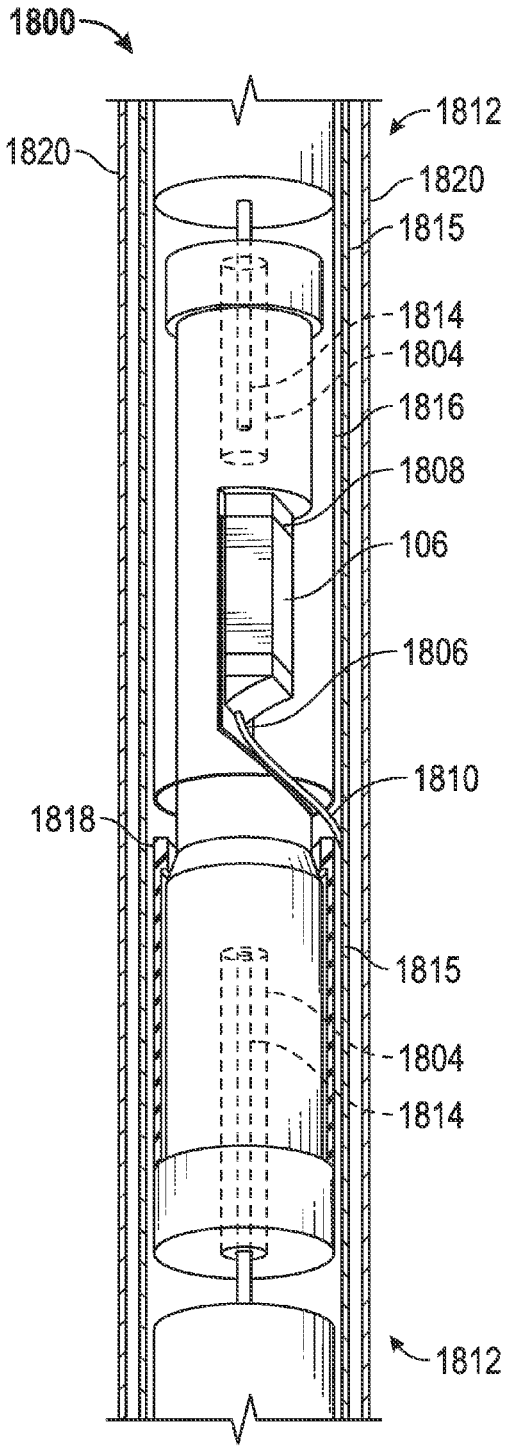
FIG. 19 is a schematic of a component platform linked to a transmission line consistent with the present invention.

FIG. 19 shows the component platform 1800 coupled onto a transmission line 1812. In one aspect, the transmission line 1812 comprises conventional coaxial cable. The platforms 1800 of the invention can be implemented for use with transmission lines comprising various types of waveguides (e.g., fiber optics) and for operation at multiple frequencies. As used herein, the term "waveguide" includes any medium selected for its transmission properties of energy between two or more points along said medium. Aspects of the invention can be implemented for use with various types of energy guides and their combinations (i.e., 'hybrid' channels), such as a microwave cavity guide, microwave microstrips, optical channels, acoustic channels, hydraulic channels, pneumatic channels, thermally conductive channels, radiation-passing/blocking channels, mechanical activation channels, etc. For electromagnetic applications, transmission line aspects may include any impedance-controlled cable (e.g., triaxial cable, parallel wires, twisted-pair copper wire, etc.). The platform 1800 unit is interposed between two segments of the transmission line 1812 to link the component 106 onto the line. As shown, in the illustrated embodiment, an outer contour of the component 106 does not exceed an outer contour (e.g., an outer diameter) of the platform 1800. Similarly, an outer contour of the platform 1800 does not exceed an outer contour (e.g., an outer diameter) of the transmission line 1812. This will allow the platform 1800 and component 106 to be disposed in small and confined conduits sized to accommodate the transmission line 1812. For coaxial cable transmission lines 1812, the cable's center conductor 1814 is inserted into the channels 1804 at each end of the platform unit. With a conductive platform 1800, electrical coupling between the cable conductor 1814 and the component 106 is achieved at junction 1808. The insulating barrier 1806 isolates the component 106 body, including the linking element 1810, from the platform 1800.

A suitable material or sleeve 1816 may be disposed or wrapped over the platform body to cover the recess 1802 and sheath the component 106, leaving an end of the linking element 1810 exposed. A non-conductive cap or sleeve 1818 is placed on the end of the platform to provide additional isolation between the exposed linking element 1810 and the unit body. Any suitable materials may be used to form the insulating barriers and sheaths on the platform 1800, including those used to implement the protective material 108 described above. The sleeve 1818 end of the platform 1800 is coupled with the transmission line 1812 such that the line's conductor 1814 engages with the channel 1804 to form a conductive junction with the platform unit.

The exposed end of the linking element 1810 is linked to another conductor/plane on the transmission line 1812 to complete the circuit with the component 106 in the line. In the case of a coaxial cable transmission line 1812, the linking element 1810 is routed to make contact with the grounding conduit 1815 around the coax. The entire platform 1800 unit and adjoining transmission line segments are then covered with a non-conductive material 1820 to seal and protect the assembly. The protective material 1820 may be disposed over the transmission line in any suitable manner. In some aspects, the protective material 1820 consists of a non-conductive sleeve disposed on the transmission line 1812 prior to insertion of the platform 1800 onto the line, whereupon the sleeve is slid over the mounted assembly. Other aspects can be implemented with a protective material 1820 wrapped around the platform assembly, or with a suitable sealing compound applied and cured on the transmission line as known in the art. In yet other aspects, additional strengthening/protection for the platform 1800 assembly may be provided as known in the art (e.g., covering the line/assembly with armored sheathing) (not shown).

Figure 20:
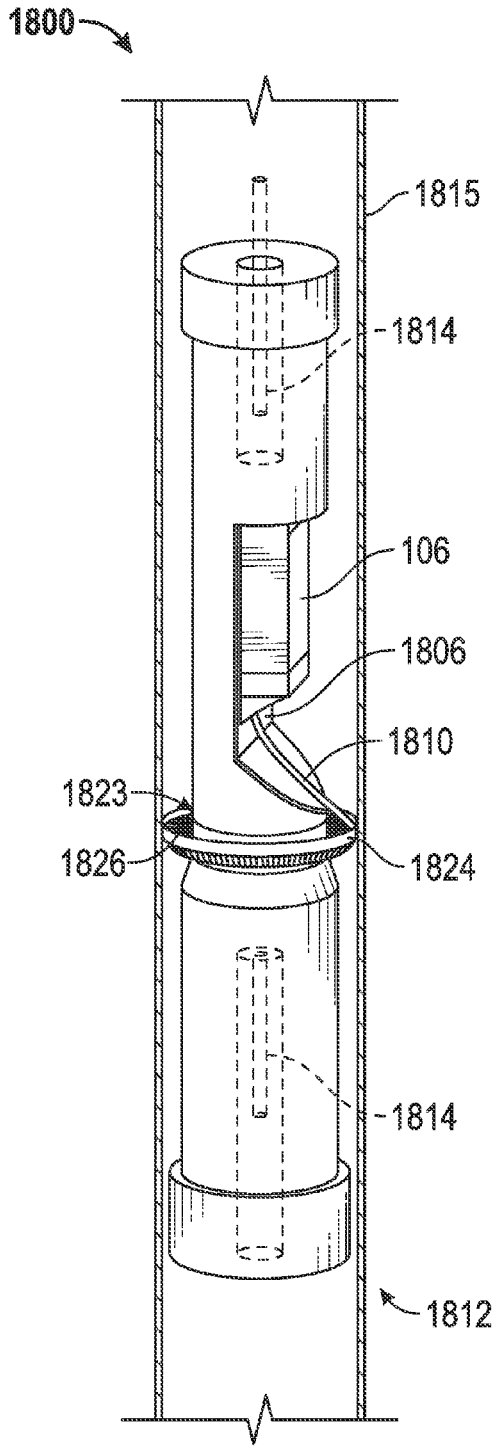
FIG. 20 is a schematic of another component platform linked to a transmission line consistent with the present invention.

FIG. 20 shows another component platform 1800 of the invention. In this aspect, an annular or donut-shaped conductor 1824 is mounted on the platform 1800 body in direct contact with the linking element 1810. The element 1810 can be securely affixed to the conductor 1824 if desired (e.g., soldering, conductive adhesive, etc.). A suitable insulating material 1826 (e.g., heat shrink) is disposed between the conductor 1824 and the platform 1800 body to isolate the conductor. In some aspects, the component insulation barrier 1806 (see FIG. 18) extends along the platform body to provide the desired conductor 1824 isolation. In other aspects, a circumferential groove or channel 1823 can be formed on the platform 1800 to accept and hold the conductor 1824 at a set position on the unit body. The conductor 1824 is preferably a one-piece element (e.g., a coiled radial spring) freely disposed on the platform 1800 to allow for movement thereon, providing greater contact reliability with a conductor on the transmission line 1812 (e.g., the grounding conduit around a coax cable).

Figure 21:
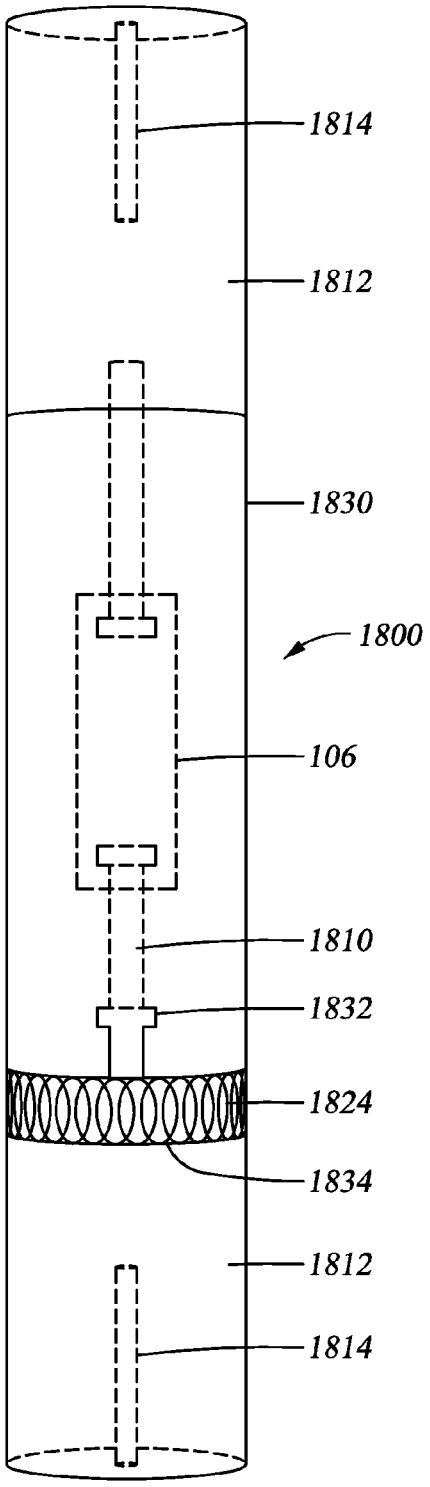
FIG. 21 is a schematic of another component platform consistent with the present invention.

FIG. 21 shows an overhead view of another component platform 1800 of the invention. In this aspect an insulating sheath 1830 is disposed on the platform 1800 to cover the component 106. The sheath 1830 is configured with an opening 1832 to allow passage of a linking element 1810 from the component 106. In one aspect, the linking element 1810 is a flexible printed circuit configured with conductive traces to establish electrical contact to form the circuit. One end of the element 1810 makes contact (e.g., via solder, conductive adhesive, etc.) with the platform 1800 body, and the other end extends through the sheath opening 1832 for connection to a conductor on the transmission line 1812, or to an intermediate conductor 1824 as described with respect to FIG. 20. In one aspect, a nonconductive annular or ring clip 1834 with walls forming a circumferential channel may be placed on the platform 1800 to hold and support the conductor 1824. The clip 1834 can be free-floating or securely mounted on the platform.

Figure 22:
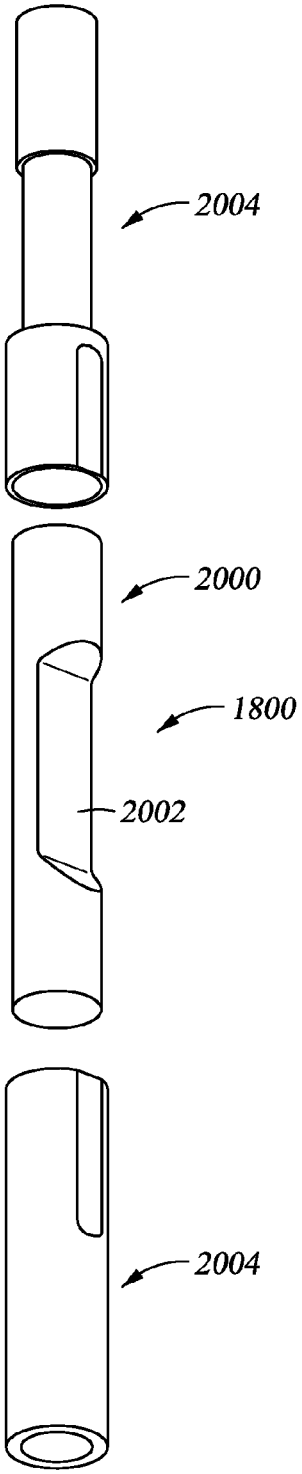
FIG. 22 is a schematic of a multi-piece component platform consistent with the present invention.
Figure 23:
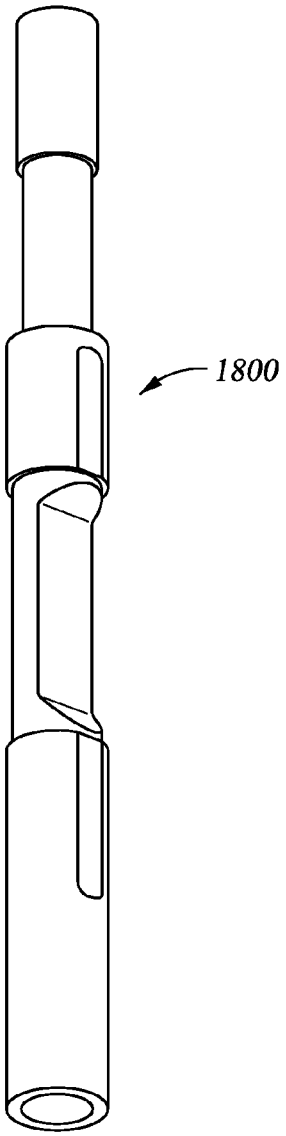
FIG. 23 is a schematic of the component platform assembly of FIG. 22.

FIG. 22 shows another component platform 1800 of the invention. In this aspect, the platform comprises a multi-piece assembly. A midbody unit 2000 is configured with a cavity or recess 2002 to accept and hold a component 106. In one aspect, the midbody unit 2000 is formed using a non-conductive material (e.g., plastic, composite, etc.). The midbody unit 2000 is configured with ends that couple with end connectors 2004 to form an assembly. With an insulating midbody unit 2000, the end connectors 2004 are formed using a conductive material such as metal. FIG. 23 shows the assembled platform 1800. The desired component(s) 106 can be disposed in the recess 2002 and linked to a transmission line as described herein.

Figure 24:
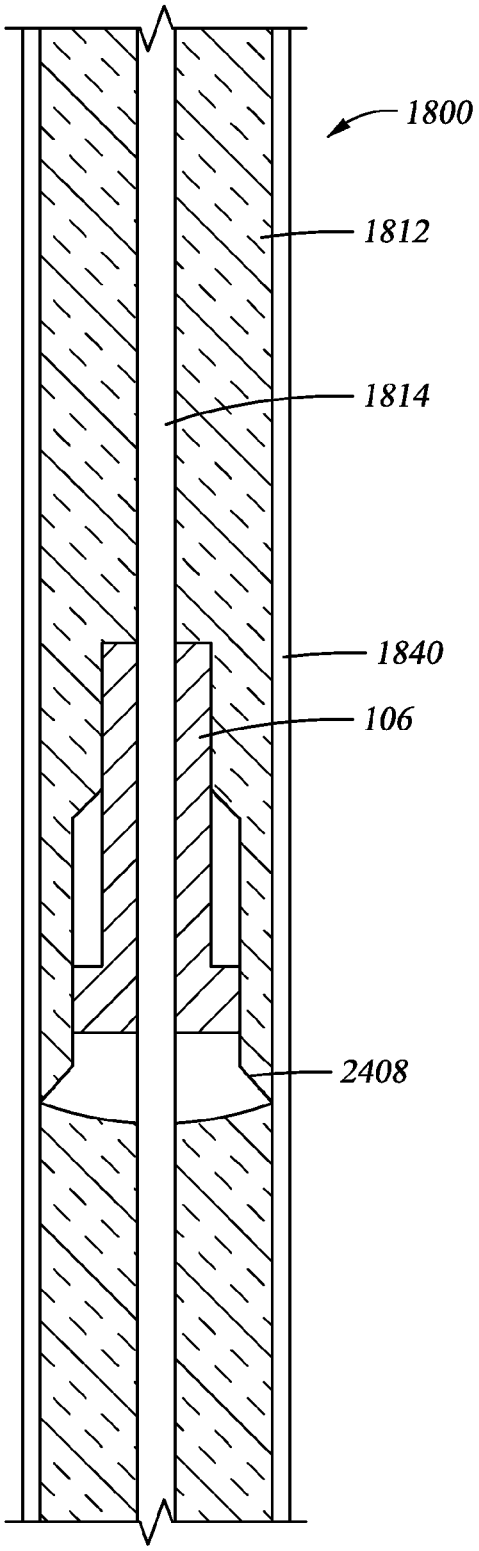
FIG. 24 is a cut-away side view of a clip-on component platform consistent with the present invention.

FIG. 24 shows a side cut-away view of another component platform 1800 of the invention. In this aspect, a platform 1800 is mounted onto the transmission line 1812 without breaking (i.e., severing) the line. In the case of a coaxial cable transmission line 1812, the component 106 is designed to clip onto the center conductor 1814. Conventional materials and techniques may be used to implement the desired components 106 (e.g., flex circuits, microchip technologies, etc.). A spring conductor 2408 is then placed in contact with the component 106 to complete the circuit with the ground plane 1840 on the cable 1812. If desired, any voids left in the cable can be filled with a suitable material. Once mounted onto the line 1812, the platform 1800 assembly can be covered/sealed in place as desired.

Aspects of the invention provide the ability to control, generate, and manipulate signal features on a transmission line in various ways. As previously discussed, components 106 configured with RFID circuitry can be disposed on a platform 1800 to provide certain features. The platforms 1800 may also be used to create conditional signal paths along a transmission line. For example, FIG. 19 shows a platform 1800 configured to mount a component 106 in electrical parallel along the transmission line. FIG. 23 shows a platform 1800 configured to mount a component 106 in series along the transmission line. The implementation of platforms 1800 with appropriate circuit topology allows one to affect signals on a transmission line in any desired way. FIG. 25 shows several circuit topologies that can be implemented with aspects of the invention to affect a signal on a transmission line.

Figure 25A:
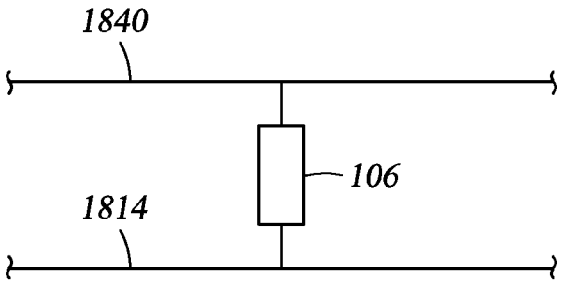
FIG. 25 depicts circuit topologies applicable to the component platforms consistent with the present invention.
Figure 25B:
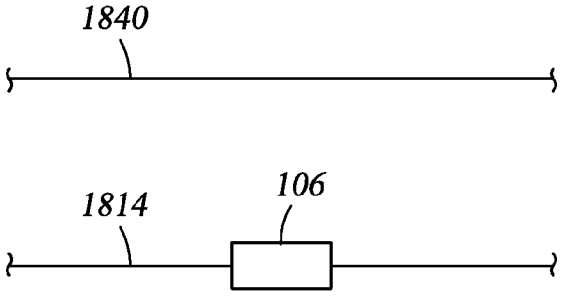

FIG. 25(A) shows a topology that may be used to configure a component 106 in parallel along the transmission line. As shown, the component 106 is connected across the center conductor 1814 and the ground conductor 1840. FIG. 25(B) shows a topology that may be used to configure a component 106 in series with the transmission line 1814. As shown, the component 106 is placed in line with the center conductor 1814.

Signal activation/control on the transmission line can also be achieved with components 106 configured to change state upon selective activation. Components 106 configured with conventional microchip technology can be mounted on the platforms 1800 to condition signals, signal paths, and/or generate signals on the line. For example, aspects of the invention can be implemented to selectively create a full or partial short to a ground plane on a transmission line (not shown). Other aspects can be implemented to selectively create a series open-circuit on the line (not shown). Such signal manipulation can be achieved by platform 1800 aspects configured with components 106 and circuit topologies as disclosed herein.

Figure 26:
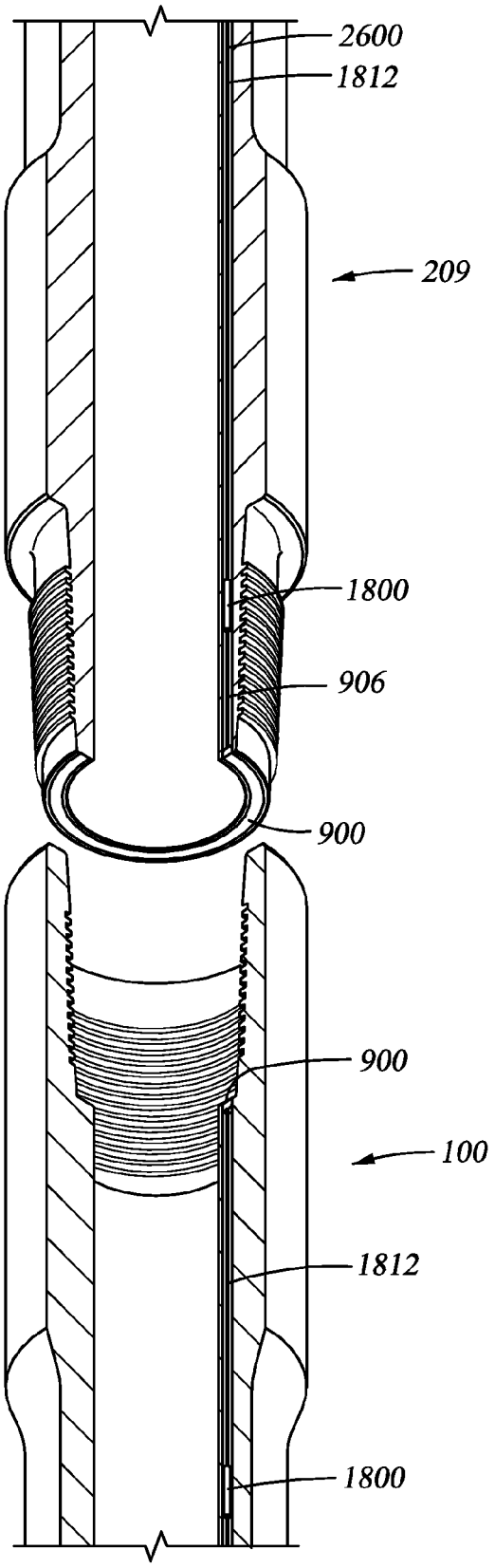
FIG. 26 is a perspective view of a pair of tubulars implemented with component platforms consistent with the present invention.

FIG. 26 shows two tubulars 209, 100 configured with component platforms 1800 of the invention. The pin-end tubular 209 comprises an inductive coupler 900 disposed thereon as disclosed herein. An electrical conductor 906 extends from the coupler 900, through the tubular wall, to couple into one end of the platform 1800 as disclosed herein. The other end of the platform 1800 is coupled to a transmission line 1812 (e.g., coaxial cable) routed through the tubular 209. In this particular aspect, the platform 1800 is disposed within a channel or conduit 2600 formed in the tubular wall. Such placement of the platform 1800 provides additional protection to the component(s) mounted on the platform. Other aspects may be implemented with a platform 1800 linked to the transmission line 1812 at points where the line is exposed inside the tubular bore or along the tubular exterior. As previously described, in some aspects the coupler 900 may be used as an external antenna for an RFID circuit disposed on the component 106 on the platform 1800. The box-end tubular 100 also comprises an inductive coupler 900 disposed thereon as disclosed herein. In this particular aspect, the platform 1800 is linked onto the transmission line 1812 at a point where the line is exposed inside the tubular bore.

Figure 27:
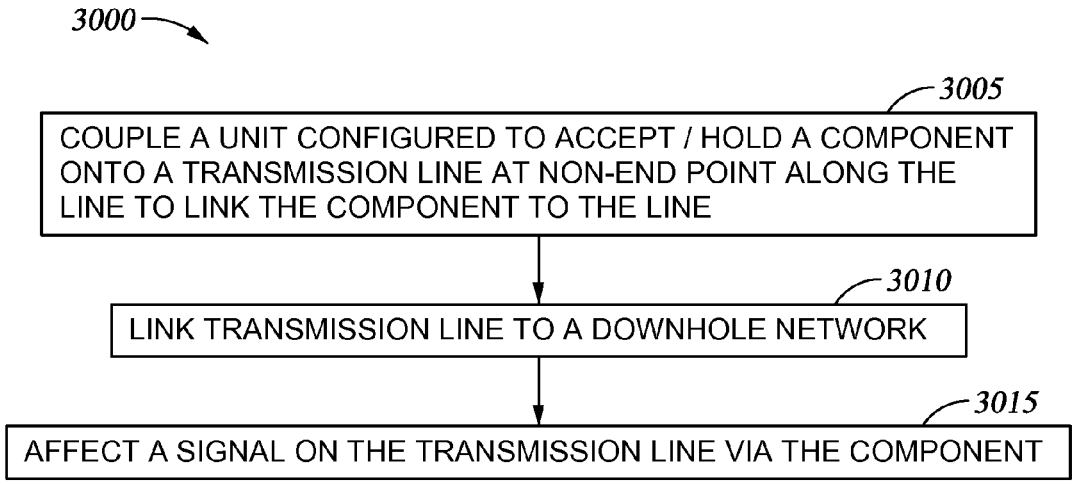
FIG. 27 is a flowchart illustrating a method for linking a component to a transmission line consistent with the present invention.

FIG. 27 depicts a flowchart of a method 3000 according to an aspect of the invention. A process for linking a component 106 to a transmission line 1812 entails coupling a platform 1800 unit onto the line at a non-end point along the line to link the component to the line, at step 3005. The unit is configured to accept and hold a component 106, as described herein. At step 3010, the transmission line is linked to a downhole network 800. At step 3015 a signal is affected on the transmission line via the component. As disclosed herein, a signal may be affected 'on' a transmission line when a signal conveyed along the transmission line is affected (including no effect at all), when a signal is generated on the transmission line, when a signal is transmitted from the transmission line, when a signal is received/detected on the transmission line, and/or when a signal path on the transmission line is affected.

Figure 28:
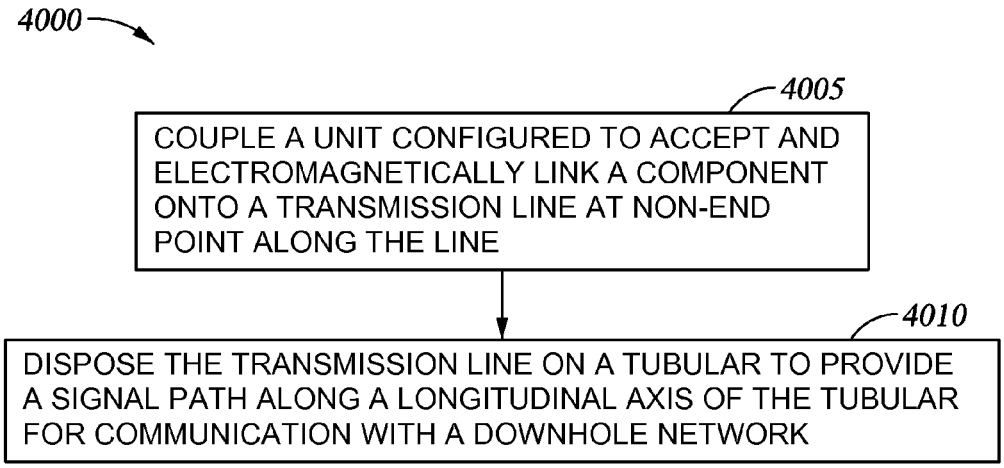
FIG. 28 is a flowchart illustrating another method for linking a component to a transmission line consistent with the present invention.

FIG. 28 depicts a flowchart of a method 4000 according to an aspect of the invention. A process for linking a component 106 to a transmission line 1812 entails coupling a platform 1800 unit onto the line at a non-end point along the line, at step 4005. The unit is configured to accept and electromagnetically link a component to the line, as described herein. At step 4010, the transmission line is disposed on a tubular 100, 209 to provide a signal path along a longitudinal axis of the tubular for communication with a downhole network 800.

Advantages provided by the disclosed techniques include, without limitation, the ability to use a very small format to make isolated component 106 connections to a downhole network 800. The platforms 1800 also allow for introduction and/or removal of hardware along a transmission line without the loss of desired signal/identification features of individual transmission lines 1812 or segments making up the transmission line. For example, a downhole tubular 100, 209 equipped with a transmission line incorporating a platform 1800 allows one to replace a coupler coil 900 on the tubular without losing any identification/parameter data (e.g., RFID signals) contained in a component 106 disposed on the platform. With aspects implemented with an addressable component 106, one can remotely command it to 'activate' and if it does not, then it is not visible to the network 800. Breaks in the network can be identified and isolated in this manner, among other uses.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for operation in networks 800 combining multiple signal conveyance formats (e.g., mud pulse, fiber-optics, etc.). The disclosed techniques are not limited to subsurface operations. Aspects of the invention are also suitable for network 800 signal manipulation conducted at, or from, surface. For example, a component platform 1800 of the invention can be disposed on, or linked to, equipment or hardware located at surface (e.g., the swivel 803 in FIG. 8) and linked to the downhole network 800. It will be appreciated by those skilled in the art that the component platforms 1800 of the invention may be implemented for use with any type of tool/tubular/system wherein a transmission line is used for signal/data/power conveyance (e.g., casing, coiled tubing, etc.). It will also be appreciated by those skilled in the art that the signal manipulation techniques disclosed herein can be implemented for selective operator activation and/or automated/autonomous operation via software configured into the downhole network (e.g., at surface, downhole, in combination, and/or remotely via wireless links tied to the network). All such similar variations apparent to those skilled in the art are deemed to be within the scope of the invention as defined by the appended claims.

What is claimed is:

1. An apparatus for electrically coupling a component to a transmission line comprising a center conductor and an outer conductive shield extending around the center conductor, the apparatus comprising:

a platform comprising a central axis, a radially outermost cylindrical surface, and a recess extending radially inward from the radially outermost cylindrical surface, wherein the recess is at least partially defined by a support surface spaced radially inward from the radially outermost surface;

an insulating barrier disposed on the support surface;

a component disposed within the recess and mounted to the insulating barrier such that the insulating barrier is radially positioned between the component and the support surface relative to the central axis of the platform;

wherein the component is configured to affect a signal on the transmission line, wherein the insulating barrier is configured to electrically isolate the component from the platform; and connector elements configured to connect the component to at least one of the center conductor and the outer conductive shield of the transmission line when the component is connected to the transmission line.

2. The apparatus of claim 1, wherein the outer conductive shield acts as a ground for the transmission line.

3. The apparatus of claim 1, wherein the component is interchangeable with other components.

4. The apparatus of claim 1, wherein the connector elements connect the component in one of electrical series and parallel along the transmission line.

5. The apparatus of claim 1, wherein the component comprises radio frequency identification (RFID) circuitry.

6. The apparatus of claim 1, wherein the component is configured to create an impedance along the transmission line.

7. The apparatus of claim 1, wherein the outer conductive shield comprises electrically conductive sheathing surrounding the transmission line.

8. The apparatus of claim 1, wherein the transmission line is linked to a downhole network.

9. The apparatus of claim 1, wherein the component is configured to create an electrical short along the transmission line.

10. The apparatus of claim 1, wherein the component is configured to create an open circuit along the transmission line.

11. The apparatus of claim 1, wherein the transmission line is disposed along a tubular having an exterior wall and a bore, to provide a signal path along the longitudinal axis of the tubular.

12. The apparatus of claim 11, wherein the tubular further comprises:

a mating surface formed intermediate the exterior wall and the bore in an end of the tubular; and an inductive coupler mounted in the mating surface and linked to the transmission line.

13. The apparatus of claim 12, wherein the inductive coupler acts as an external antenna for an RFID circuit disposed on the component.

14. The apparatus of claim 11, wherein the platform is at least partially disposed within a wall of the tubular.

15. The apparatus of claim 1, wherein the connector elements are configured to electromagnetically link the component to the transmission line.

16. The apparatus of claim 1, wherein the component comprises at least one of a capacitor, an RDIF circuit, an inductor, a resistor, an integrated circuit, an active circuit, and a passive circuit.

17. The apparatus of claim 1, further comprising a power source to supply power to the component.

18. The apparatus of claim 1, further comprising an annular conductor, wherein the component is electrically coupled to the annular conductor, and wherein the annular conductor includes a radially outermost surface relative to the central axis of the platform that engages with the outer conductive shield of the transmission line.

19. The apparatus of claim 18, wherein the annular conductor is coupled to the platform with a flexible linking element.

20. The apparatus of claim 18, wherein the platform further comprises a circumferential groove configured to accept and hold the annular conductor.

21. The apparatus of claim 18, further comprising an insulating material disposed between the annular conductor and the platform.

22. The apparatus of claim 1, wherein the platform is configured to fit inside the outer conductive shield of the transmission line.

23. A system comprising:

a component;

a transmission line comprising a center conductor and an outer conductive shield extending around the center conductor;

a platform having a central axis and being disposed along the transmission line;

an insulating barrier disposed on a surface of the platform, wherein the component is mounted to the insulating barrier such that the insulating barrier is radially positioned between the component and the surface relative to the central axis of the platform wherein the insulating barrier is configured to electrically isolate the component from the platform;

a linking element coupling the component to the outer conductive shield;

an annular conductor disposed about the platform and extending radially outward from the platform to the outer conductive shield; and a connector element electrically coupling the component to the center conductor.

24. The system of claim 23, wherein the outer conductive shield comprises electrically conductive sheathing surrounding the transmission line.

25. The system of claim 23, wherein the component comprises at least one of a circuit board, a capacitor, an RFID circuit, an inductor, a resistor, an integrated circuit, an active circuit, and a passive circuit.

26. The system of claim 23, wherein the component is configured to affect a signal on the transmission line;

wherein the platform is configured to electrically couple the component to at least one of the center conductor and the outer conductive shield of the transmission line; and wherein the transmission line is disposed on a tubular to provide a signal path along a longitudinal axis of the tubular for communication with a downhole network.

27. The system of claim 26, further comprising a non-conductive coating covering the outer conductive shield, the platform and the component.

28. The system of claim 26, wherein the platform further comprises bores or channels for receiving the center conductor of the transmission line.

29. The system of claim 23, wherein the flexible linking element is coupled to the annular conductor and wherein the annular conductor has a radially outermost surface relative to the central axis of the platform that engages with the outer conductive shield of the transmission line.

30. The system of claim 29, wherein the platform further comprises a circumferential groove configured to accept and hold the annular conductor.

31. The system of claim 30, further comprising an insulating material disposed between the annular conductor and the platform.

32. The system of claim 23, wherein the platform is configured to fit inside the outer conductive shield of the transmission line.

33. A method for electrically coupling a component to a transmission line comprising a center conductor and an outer conductive shield extending around the center conductor, the method comprising:

disposing a platform between a first segment and a second segment of the coaxial transmission line, wherein the platform comprises a central axis, a radially outermost surface, and a recess extending radially inward from the outermost surface, wherein the recess is at least partially defined by a support surface spaced radially inward from the radially outermost surface;

disposing an insulating barrier on the support surface;

mounting the component within the recess and on the insulating barrier such that the insulating barrier is radially positioned between the component and the support surface relative to the central axis of the platform;

electrically isolating the component from the platform with the insulating barrier;

connecting the component to at least one of the center conductor and the outer conductive shield of the transmission line;

linking the transmission line to a downhole network; and affecting a signal on the transmission line with the component.

34. The method of claim 33, further comprising remotely activating the component via the downhole network.

35. The method of claim 33, further comprising disposing the transmission line on a tubular to provide a signal path along a longitudinal axis of the tubular for communication with the downhole network.

36. The method of claim 35, further comprising determining a connectivity status of the tubular by remote activation of the component via the downhole network.

37. The method of claim 33, wherein connecting the component to at least one of the center conductor and the outer conductive shield of the transmission line comprises:

coupling the component to the outer conductive shield of the transmission line via a flexible linking element; and inserting the center conductor of the transmission line into a channel extending axially from one end of the platform.

38. The method of claim 33, wherein disposing a platform between a first segment and a second segment of the transmission line comprises inserting the platform into the outer conductive shield of the transmission line.

39. A method for electrically coupling a component to a transmission line comprising a center conductor and an outer conductive shield extending around the center conductor, the method comprising:

disposing an insulating barrier on a surface of a platform, wherein the platform includes a central axis;

mounting a component to the insulating barrier such that the insulating barrier is radially positioned between the component and the surface relative to the central axis of the platform;

electrically isolating the component from the surface of the platform with the insulating barrier;

electrically coupling the component to the outer conductive shield of the transmission line with an annular conductor extending radially outward from the platform to the outer conductive shield;

electrically coupling the component to the center conductor of the transmission line; and disposing the transmission line on a tubular to provide a signal path along a longitudinal axis of the tubular for communication with a downhole network.

40. The method of claim 39, further comprising inserting the platform into the outer conductive shield of the transmission line.

* * * * *